US010718302B2

(12) United States Patent
Aoki

(10) Patent No.: US 10,718,302 B2
(45) Date of Patent: Jul. 21, 2020

(54) FUEL INJECTION DEVICE

(71) Applicant: DENSO CORPORATION, Kariya, Aichi-pref. (JP)

(72) Inventor: Hiromu Aoki, Kariya (JP)

(73) Assignee: DENSO CORPORATION, Kariya (JP)

( * ) Notice: Subject to any disclaimer, the term of this patent is extended or adjusted under 35 U.S.C. 154(b) by 218 days.

(21) Appl. No.: 15/763,614

(22) PCT Filed: Sep. 12, 2016

(86) PCT No.: PCT/JP2016/076789
§ 371 (c)(1),
(2) Date: Mar. 27, 2018

(87) PCT Pub. No.: WO2017/056940
PCT Pub. Date: Apr. 6, 2017

(65) Prior Publication Data

US 2018/0291850 A1 Oct. 11, 2018

(30) Foreign Application Priority Data

Oct. 2, 2015 (JP) ..... 2015-196824

(51) Int. Cl.
*F02M 51/06* (2006.01)
*F02M 55/00* (2006.01)
*F02M 51/00* (2006.01)

(52) U.S. Cl.
CPC ..... *F02M 51/0671* (2013.01); *F02M 51/06* (2013.01); *F02M 51/0614* (2013.01);
(Continued)

(58) Field of Classification Search
CPC .. F02M 51/0671; F02M 55/004; F02M 51/06; F02M 55/005; F02M 51/0614; F02M 51/005
See application file for complete search history.

(56) References Cited

U.S. PATENT DOCUMENTS 7,021,569 B1 * 4/2006 Ogura ..... F02M 51/0671 239/533.11
2002/0043575 A1 * 4/2002 Sekine ..... F02M 51/005 239/585.1

(Continued)

FOREIGN PATENT DOCUMENTS

JP 2006-017026 1/2006
JP 2006017026 A * 1/2006

(Continued)

*Primary Examiner* — Sizo B Vilakazi
(74) *Attorney, Agent, or Firm* — Nixon & Vanderhye P.C.

(57) ABSTRACT

The housing includes a first cylinder part having a first end connected to a nozzle, a second cylinder part having a first end connected to a second end of the first cylinder part and forming a magnetic throttle part in at least a part of the second cylinder part in an axial direction, a third cylinder part having a first end connected to a second end of the second cylinder part, and a fuel passage formed inside the first cylinder part, the second cylinder part, and the third cylinder part so as to communicate with injection holes and guide the fuel to the injection holes. A yoke has a cylindrical shape, of which the first end side is connected to the first cylinder part and the second end side is connected to the third cylinder part, and is provided on a radially outer side of the housing such that an axial force is generated in the first cylinder part and the third cylinder part in a direction in which the first cylinder part and the third cylinder part approach each other.

6 Claims, 11 Drawing Sheets

(52) U.S. Cl.
CPC ..... *F02M 55/004* (2013.01); *F02M 55/005* (2013.01); *F02M 51/005* (2013.01)

(56) References Cited

U.S. PATENT DOCUMENTS

| | | | | |
|---|---|---|---|---|
| 2007/0194151 | A1* | 8/2007 | Hayatani | F02M 51/0685 239/585.1 |
| 2012/0000995 | A1* | 1/2012 | Wolff | F02M 61/168 239/533.3 |
| 2014/0175194 | A1* | 6/2014 | Imai | F02M 51/0614 239/585.1 |
| 2016/0097358 | A1* | 4/2016 | Miyake | F02M 51/0671 239/585.1 |

FOREIGN PATENT DOCUMENTS

| | | |
|---|---|---|
| JP | 2008-303879 | 12/2008 |
| JP | 2014-092060 | 5/2014 |

* cited by examiner

FUEL INJECTION DEVICE

CROSS REFERENCE TO RELATED APPLICATION

This application is the U.S. national phase of International Application No. PCT/JP2016/076789 filed Sep. 12, 2016 which designated the U.S. and claims priority to Japanese Patent Application No. 2015-196824 filed on Oct. 2, 2015, the entire contents of each of which are incorporated herein by reference.

TECHNICAL FIELD

The present disclosure relates to a fuel injection device that injects and supplies fuel into an internal combustion engine.

BACKGROUND ART

Recently, there is a growing need for a fuel injection device that can inject a high-pressure fuel. Hence, the fuel pressure in a fuel passage tends to increase during use of the fuel injection device. In a fuel injection device described in Patent Document 1, a nozzle holder configuring part of a housing is press-fitted in a stationary core. The stationary core is joined by welding to the nozzle holder at a press-fitting position. The nozzle holder has a magnetic throttle part having a small thickness portion. The magnetic throttle part is press-fitted in the stationary core and is joined by welding to the stationary core.

In the fuel injection device of Patent Document 1, when the fuel pressure in a fuel passage in the device increases, a force, by which the stationary core separates from the nozzle holder in an axial direction, acts on a welded portion of the stationary core and the nozzle holder or on the thin magnetic throttle part. If the fuel pressure in the fuel passage in the device excessively increases, stress is concentrated on the welded portion of the stationary core and the nozzle holder or the magnetic throttle part, and thus the welded portion or the magnetic throttle part may be broken due to the stress concentration. If the welded portion or the magnetic throttle part is broken, the fuel in the fuel passage may leak to the outside. Consequently, the fuel injection device of Patent Document 1 is structurally difficult to inject high-pressure fuel.

In the fuel injection device of Patent Document 1, when the fuel pressure in the fuel passage in the device excessively increases, a position of the magnetic throttle part with respect to the stationary core is shifted in the axial direction, and the magnitude of magnetic attractive force, which is generated between the stationary core and the movable core, may be varied. This may reduce fuel injection accuracy.

PRIOR ART DOCUMENT

Patent Document

Patent Document 1: JP 2014-227958 A

SUMMARY OF INVENTION

An object of the present disclosure is to provide a fuel injection device capable of accurately injecting a high-pressure fuel while suppressing fuel leakage.

The fuel injection device of the present disclosure includes a nozzle, a housing, a needle, a movable core, a stationary core, a valve-seat-side biasing component, a yoke, and a coil. The nozzle includes injection holes to inject fuel, and a valve seat annually formed around the injection holes.

The housing includes a first cylinder part having a first end connected to the nozzle, a second cylinder part having a first end connected to a second end of the first cylinder part and forming a magnetic throttle part in at least a part of the second cylinder part in the axial direction, a third cylinder part having a first end connected to a second end of the second cylinder part, and a fuel passage formed inside the first, second, and third cylinder parts so as to communicate with the injection holes and guide the fuel to the injection holes.

The needle includes a rod-like needle body and a seal part that is annually formed at one end of the needle body so as to be able to abut on the valve seat, and opens or closes the injection holes as the seal part separates from or abuts on the valve seat. The movable core is provided so as to be able to reciprocate together with the needle within the housing. The stationary core is provided on the side opposite to the valve seat with respect to the movable core inside the second and third cylinder parts. The valve-seat-side biasing component can bias the needle and the movable core toward the valve seat.

The yoke has a cylindrical shape, of which the first end side is connected to the first cylinder part and the second end side is connected to the third cylinder part, and is provided on a radially outer side of the housing such that an axial force is generated in the first cylinder part and the third cylinder part in the direction in which the first and third cylinder parts approach each other.

The coil is provided between the housing and the yoke, and is energized to be able to form a magnetic circuit through the first cylinder part, the movable core, the stationary core, the third cylinder part, and the yoke, and thus able to attract the movable core toward the stationary core and move the needle to the side opposite to the valve seat.

In the present disclosure, the yoke is provided such that an axial force is generated in the first and third cylinder parts in the direction in which the first and third cylinder parts approach each other. Hence, a contractile force in the axial direction acts on the second cylinder part forming the magnetic throttle part from the first and third cylinder parts. As a result, even if the fuel pressure in the fuel passage increases, it is possible to suppress "a force by which the components separate from each other in the axial direction", which acts on a connection between the second and first cylinder parts, a connection between the second and third cylinder parts, or the magnetic throttle part. It is therefore possible to suppress stress concentration on the connection between the second and first cylinder parts, the connection between the second and third cylinder parts, or the magnetic throttle part, and suppress break caused by the stress concentration. Consequently, the present disclosure makes it possible to inject high-pressure fuel while suppressing fuel leakage.

In the present disclosure, since the contractile force in the axial direction acts on the second cylinder part forming the magnetic throttle part from the first and third cylinder parts, even if the fuel pressure in the fuel passage increases, it is possible to suppress axial shift of a position of the magnetic throttle part with respect to the stationary core. It is therefore possible to suppress a variation in the magnitude of the magnetic attraction force generated between the stationary core and the movable core. This makes it possible to suppress a reduction in injection accuracy of the fuel.

As described above, the fuel injection device of the present disclosure can accurately inject the high-pressure fuel while suppressing fuel leakage.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Figure 1:
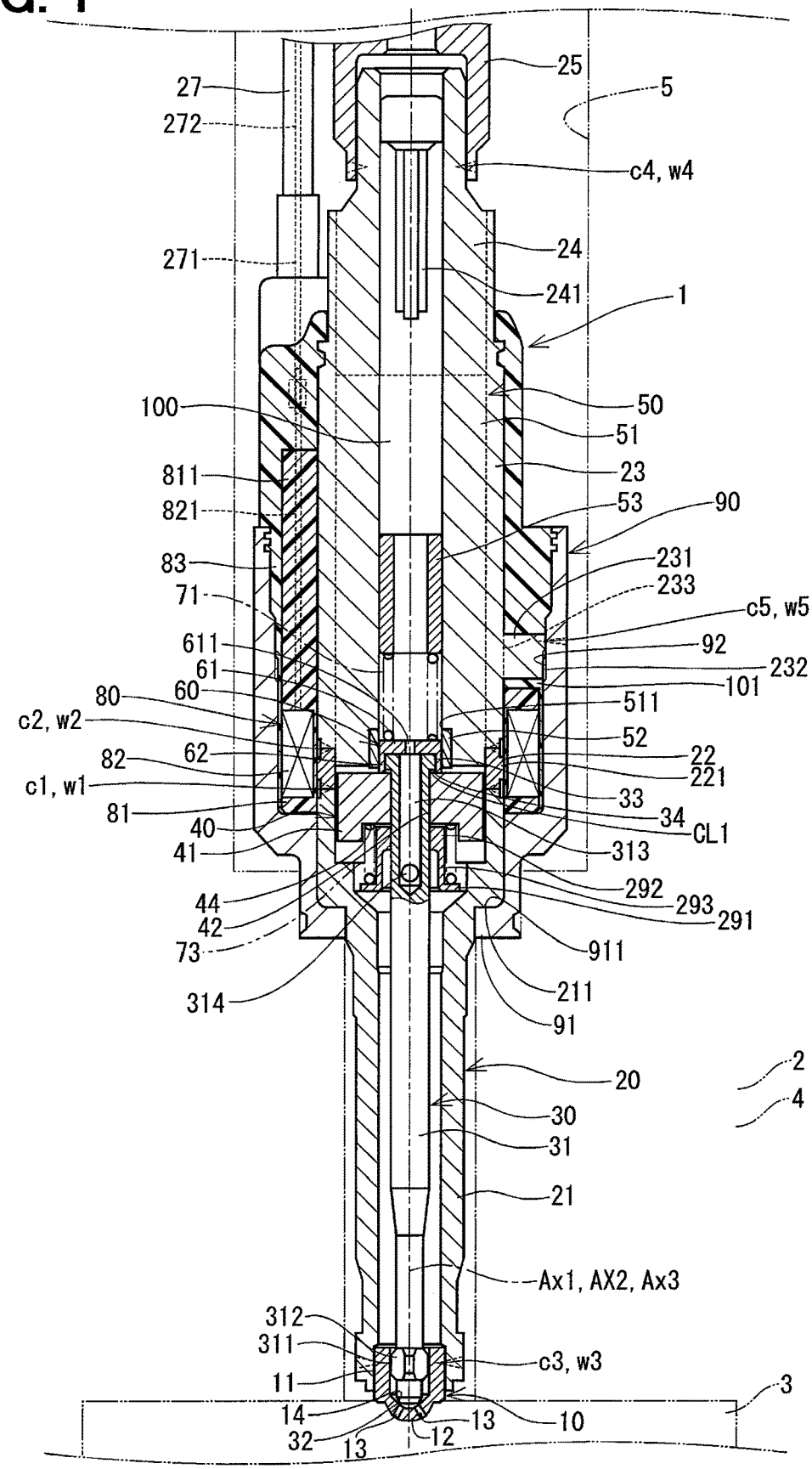
FIG. 1 is a sectional view illustrating a fuel injection device of a first embodiment of the present disclosure.

Hereinafter, some embodiments of the present disclosure are described with reference to drawings. In the embodiments, substantially the same components are designated by the same reference numeral, and duplicated description is omitted.

First Embodiment

FIG. 1 illustrates a fuel injection valve of a first embodiment of the present disclosure. The fuel injection device 1 is used for, for example, a direct-injection gasoline engine (hereinafter "engine") 2 as an internal combustion engine, and injects and supplies gasoline as a fuel into the engine 2.

The fuel injection device 1 includes a nozzle 10, a housing 20, a needle 30, a movable core 40, a stationary core 50, a gap formation component 60, a spring 71 as a valve-seat-side biasing component, a coil 80, a yoke 90, an inlet part 24, a filter 241, a cylindrical component 25, a screw coupling component 26, and the like.

The nozzle 10 is made of a material having a relatively high hardness such as martensite stainless steel, for example. The nozzle 10 is subjected to hardening so as to have a predetermined hardness. The nozzle 10 includes a nozzle cylinder part 11 and a nozzle bottom 12 to close one end of the nozzle cylinder part 11. The nozzle bottom 12 has a plurality of injection holes 13 that connect a surface of the nozzle on the side closer to the nozzle cylinder part 11 and a surface of the nozzle on the side opposite to the nozzle cylinder part 11. An annular valve seat 14 is formed around the injection holes 13 on the surface of the nozzle bottom 12 on the side closer to the nozzle cylinder part 11. The housing 20 includes a first cylinder part 21, a second cylinder part 22, a third cylinder part 23, and the like.

Each of the first, second, and third cylinder parts 21, 22, and 23 has a substantially cylindrical shape. The first, second, and third cylinder parts 21, 22, and 23 are disposed in this order so as to be coaxial with one another while being connected to one another. The second cylinder part 22 is connected to the first and third cylinder parts 21 and 23 by welding, for example. In FIG. 1, a connection between the second cylinder part 22 and the first cylinder part 21 is indicated by c1, and a connection between the second cylinder part 22 and the third cylinder part 23 is indicated by c2. The connection c1 has a melt w1 formed by melting, cooling, and solidification through welding of part of the second cylinder part 22 and part of the first cylinder part 21. The connection c2 has a melt w2 formed by melting, cooling, and solidification through welding of part of the second cylinder part 22 and part of the third cylinder part 23.

The first and third cylinder parts 21 and 23 are each made of a magnetic material such as ferritic stainless steel, for example, and are subjected to magnetic stabilization treatment. The first cylinder part 21 and the third cylinder part 23 each have a relatively low hardness. The second cylinder part 22 is made of a nonmagnetic material such as austenitic stainless steel, for example. In other words, the second cylinder part 22 forms a magnetic throttle part 221 over the whole area thereof in the axial direction. Hardness of the second cylinder part 22 is higher than hardness of each of the first and third cylinder parts 21 and 23.

The end portion of the nozzle cylinder part 11 on the side opposite to the nozzle bottom 12 is connected to the inside of the end portion of the first cylinder part 21 on the side opposite to the second cylinder part 22. The first cylinder part 21 is connected to the nozzle 10 by welding, for example. In FIG. 1, a connection between the first cylinder part 21 and the nozzle 10 is indicated by c3. The connection c3 has a melt w3 formed by melting, cooling, and solidification through welding of part of the first cylinder part 21 and part of the nozzle 10.

The inlet part 24 has a cylindrical shape formed of a metal such as stainless steel, for example. The inlet part 24 is provided such that its one end is connected to the radially inside of the end portion of the third cylinder part 23 on the side opposite to the second cylinder part 22. In the first embodiment, the inlet part 24 and the third cylinder part 23 are integrally made of the same material. In FIG. 1, the boundary between the inlet part 24 and the third cylinder part 23 is indicated by a two-dot chain line.

The cylindrical component 25 is provided on the side, opposite to the third cylinder part 23, of the inlet part 24. The cylindrical component 25 has a cylindrical shape formed of a metal such as stainless steel, for example. The cylindrical component 25 is provided such that its one end is connected to the radially outer side of the end portion of the inlet part 24 on the side opposite to the third cylinder part 23. In the first embodiment, the cylindrical component 25 is connected to the inlet part 24 by welding, for example. In FIG. 1, a connection between the cylindrical component 25 and the inlet part 24 is indicated by c4. The connection c4 has a melt w4 formed by melting, cooling, and solidification through welding of part of the cylindrical component 25 and part of the inlet part 24. A screw part 251 is provided on an outer wall of the end portion of the cylindrical component 25 on the side opposite to the inlet part 24.

A fuel pipe 6, through which fuel flows from an outside, is connected to the end portion of the cylindrical component 25 on the side opposite to the inlet part 24. A protrusion 7, which annually protrudes to the radially outer side, is provided on the end portion of the fuel pipe 6 on the side closer to the cylindrical component 25. A stopping surface 8 is provided on an end surface of the protrusion 7 on the side opposite to the cylindrical component 25.

The screw coupling component 26 has a cylindrical shape formed of a metal such as stainless steel, for example. A screw part 261 that can be screwed with the screw part 251 is provided on an inner wall of a first end portion of the screw coupling component 26. A protrusion 262, which annually protrudes to the radially inside, is provided on a second end portion of the screw coupling component 26. A stopping surface 263 is provided on an end surface of the protrusion 262 on the side closer to the screw part 261.

With the screw coupling component 26, the screw part 261 is screwed with the screw part 251 such that the end surface of the cylindrical component 25 on the side opposite to the inlet part 24 abuts on the end surface of the fuel pipe 6 on the side closer to the cylindrical component 25 so that the stopping surface 263 is in abutment with the stopping surface 8. At this time, an axial force acts on the cylindrical component 25 and the fuel pipe 6 in the direction in which the cylindrical component 25 and the fuel pipe 6 approach each other. As a result, the end surface of the cylindrical component 25 on the side opposite to the inlet part 24 is coupled to the end surface of the fuel pipe 6 on the side closer to the cylindrical component 25 in a closely contact manner.

A fuel passage 100 is provided inside the housing 20 and the nozzle cylinder part 11. The fuel passage 100 communicates with the injection holes 13. As a result, the fuel from the outside, such as a fuel supply source, flows into the fuel passage 100 through the fuel pipe 6, the cylindrical component 25, and the inlet part 24. The fuel passage 100 guides the fuel to the injection holes 13. The inlet part 24 and the cylindrical component 25 collectively correspond to "fuel inlet". The filter 241 is provided inside the inlet part 24. The filter 241 collects foreign matters in the fuel flowing into the fuel passage 100.

The needle 30 is made of a material having a relatively high hardness such as martensitic stainless steel, for example. The needle 30 is subjected to hardening so as to have a predetermined hardness. Hardness of the needle 30 is set substantially equal to hardness of the nozzle part 10. The needle 30 is accommodated in the housing 20 so as to be able to reciprocate within the fuel passage 100 in a direction of the axis Ax1 of the housing 20. The needle 30 includes a needle body 31, a seal part 32, a rib 33, and the like. The needle body 31 has a rod-like shape, more specifically a long columnar shape. The seal part 32 is formed at a first end of the needle body 31, i.e., formed in the end portion of the needle body 31 on the side closer to the valve seat 14, and can abut on the valve seat 14.

The rib 33, having a ring shape, is provided at a second end of the needle body 31, i.e., formed on the radially outer side of the end portion of the needle body 31 on the side opposite to the valve seat 14. In the first embodiment, the rib 33 and the needle body 31 are integrally made of the same material.

As shown in FIG. 1, a large diameter portion 311 is provided in the vicinity of the first end of the needle body 31. The outer diameter of the needle body 31 is smaller on the first end side than on the second end side. The outer diameter of the large diameter portion 311 is larger than the outer diameter on the first side of the needle body 31 and equal to the outer diameter on the second end side of the needle body 31. The large diameter portion 311 is formed such that its outer wall is slidable along the inner wall of the nozzle cylinder portion 11 of the nozzle 10. As a result, reciprocation of the end portion of the needle 30 on the side closer to the valve seat 14 is guided in the axis Ax1 direction. The large diameter portion 311 has chamfered portions 312 in such a manner that a plurality of circumferential portions of its outer wall are chamfered. As a result, the fuel can flow between the chamfered portions 312 and the inner wall of the nozzle cylinder portion 11 of the nozzle 10.

The second end of the needle body 31 has an axial hole 313 extending along the axis Ax2 of the needle body 31. That is, the second end of the needle body 31 has a hollow cylindrical shape. The needle body 31 has a radial hole 314 extending in the radial direction of the needle body 31 so as to connect the end portion of the axial hole 313 on the side closer to the valve seat 14 and a space outside the needle body 31. As a result, the fuel in the fuel passage 100 can flow through the axial hole 313 and the radial hole 314. In this way, the needle body 31 has the axial hole 313 that extends in an axis Ax2 direction from the end surface of the needle body 31 on the side opposite to the valve seat 14 and communicates with a space outside the needle body 31 through the radial hole 314.

The needle 30 opens or closes the injection holes 13 as the seal part 32 separates from (leaves) or abuts on (seats on) the valve seat 14. Hereinafter, the direction in which the needle 30 separates from the valve seat 14 is appropriately referred to as valve opening direction, and the direction in which the needle 30 abuts on the valve seat 14 is appropriately referred to as valve closing direction.

The movable core 40 has a movable core body 41. The movable core body 41 has a substantially columnar shape formed of a magnetic material such as ferritic stainless steel, for example. The movable core body 41 is subjected to magnetic stabilization treatment. Hardness of the movable core body 41 is relatively low, and is substantially equal to hardness of each of the first and third cylinder parts 21 and 23 of the housing 20.

The movable core 40 has an axial hole 42 and a recess 44. The axial hole 42 is formed so as to extend along an axis Ax3 of the movable core body 41. In the first embodiment, the inner wall of the axial hole 42 is subjected to hard treatment and sliding resistance reduction treatment such as Ni—P plating, for example. The recess 44 is formed in the center of the movable core body 41 so as to be circularly depressed from the surface on the side closer to the valve seat 14 to the side opposite to the valve seat 14 of the movable core body 41. The axial hole 42 is opened to the bottom of the recess 44.

The movable core 40 is accommodated within the housing 20 while the needle body 31 of the needle 30 runs through the axial hole 42. The axial hole 42 of the movable core 40 has an inner diameter set equal to or slightly larger than the outer diameter of the needle body 31 of the needle 30. The movable core 40 is movable relative to the needle 30 as the inner wall of the axial hole 42 slides on the outer wall of the needle body 31 of the needle 30. As with the needle 30, the movable core 40 is accommodated in the housing 20 so as to be able to reciprocate within the fuel passage 100 in the direction of the axis Ax1 of the housing 20. In the first embodiment, a surface of the movable core body 41 on the side opposite to the valve seat 14 is subjected to hard treatment and wear resistance treatment such as hard chromium plating, for example.

The outer diameter of the movable core body 41 is set smaller than the inner diameter of each of the first and second cylinder parts 21 and 22 of the housing 20. Hence, when the movable core 40 reciprocates within the fuel passage 100, the outer wall of the movable core 40 does not slide along the inner wall of each of the first and second cylinder parts 21 and 22.

Figure 3:
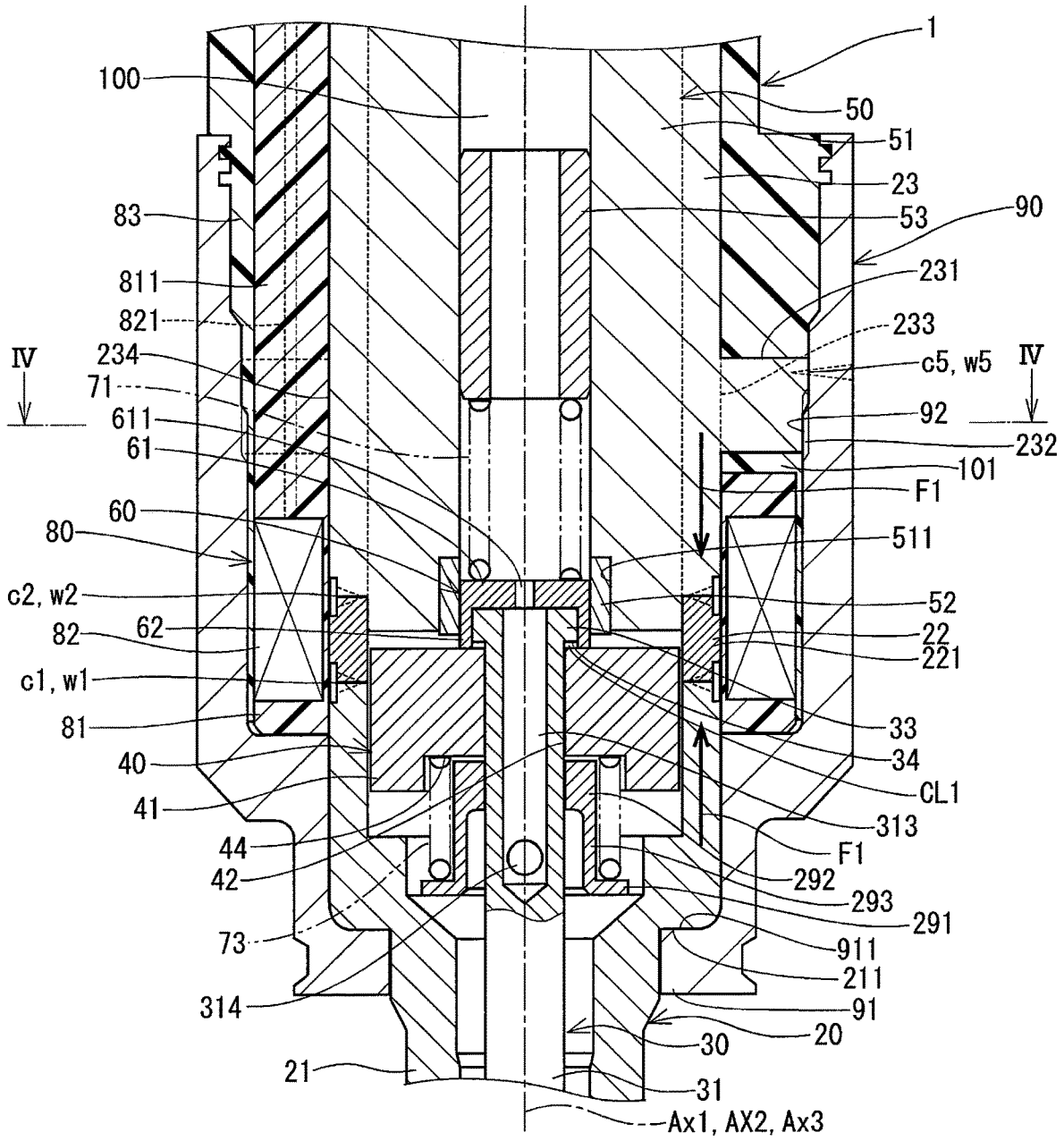
FIG. 3 is a sectional view illustrating a yoke of the fuel injection device of the first embodiment of the disclosure and the vicinity of the yoke.

As shown in FIG. 3, the surface, which is on the side closer to the valve seat 14, of the rib 33 of the needle 30 can abut on the surface of the movable core body 41 on the side opposite to the valve seat 14. That is, the needle 30 has an abutment surface 34 that can abut on the surface of the movable core body 41 on the side opposite to the valve seat 14. The abutment surface 34 is formed in the surface of the rib 33 on the side closer to the valve seat 14. The movable core 40 is provided movably relative to the needle 30 so as to be able to abut on or separate from the abutment surface 34.

As shown in FIG. 1, the stationary core 50 is provided on the side opposite to the valve seat 14 with respect to the movable core 40 inside the housing 20. The stationary core 50 includes a stationary core body 51 and a bush 52. The stationary core body 51 has a substantially cylindrical shape formed of a magnetic material such as ferritic stainless steel, for example. The stationary core body 51 is subjected to magnetic stabilization treatment. Hardness of the stationary core body 51 is relatively low, and is substantially equal to hardness of the movable core body 41.

In the first embodiment, the stationary core body 51, the third cylinder part 23, and the inlet part 24 are integrally made of the same material. In FIG. 1, the boundaries between the stationary core body 51, the third cylinder part 23, and the inlet part 24 are each indicated by a two-dot chain line.

The bush 52 has a substantially cylindrical shape formed of a material having a relatively high hardness such as martensitic stainless steel, for example. The bush 52 is provided in a recess 511 formed so as to be depressed to the radially outer side from the inner wall of the end portion of the stationary core body 51 on the side closer to the valve seat 14. The inner diameter of the bush 52 is substantially equal to the inner diameter of the stationary core body 51. An end surface of the bush 52 on the side closer to the valve seat 14 is located closer to the valve seat 14 than the end surface of the stationary core body 51 on the side closer to the valve seat 14. Hence, the surface of the movable core body 41 on the side opposite to the valve seat 14 can abut on the end surface of the bush 52 on the side closer to the valve seat 14.

The stationary core 50 is provided such that the rib 33 of the needle 30 is located inside the bush 52 while the seal part 32 is in abutment with the valve seat 14. A cylindrical adjusting pipe 53 is provided by press fitting inside the stationary core body 51. The gap formation component 60 is made of a non-magnetic material, for example. Hardness of the gap formation component 60 is set substantially equal to hardness of each of the needle 30 and the bush 52.

The gap formation component 60 is provided on the side opposite to the valve seat 14 with respect to the needle 30 and the movable core 40. As shown in FIG. 3, the gap formation component 60 includes a plate part 61 and an extension 62. The plate part 61 has a substantially plate shape. The plate part 61 is provided on the side opposite to the valve seat 14 with respect to the needle 30 such that its one end surface can abut on the rib 33 and the needle body 31.

The extension 62 is formed integrally with the plate part 61 so as to extend cylindrically to the valve seat 14 side from an outer peripheral portion of one end surface of the plate part 61. That is, in the first embodiment, the gap formation component 60 has a bottomed cylindrical shape. The gap formation component 60 is provided such that the rib 33 of the needle 30 is located inside the extension 62. The end portion of the extension 62 on the side opposite to the plate part 61 can abut on the surface of the movable core body 41 on the side closer to the stationary core 50.

In the first embodiment, the length in the axial direction of the extension 62 is longer than the length in the axial direction of the rib 33. Hence, when the plate part 61 abuts on the needle 30 while the extension 62 abuts on the movable core 40, the gap formation component 60 can form an axial gap CL1, which is a gap in the axis Ax2 direction between the surface of the rib 33 on the side closer to the valve seat 14 and the surface of the movable core 40 on the side opposite to the valve seat 14.

The inner diameter of the extension 62 is set equal to or slightly larger than the outer diameter of the rib 33. With the gap formation component 60, therefore, the inner wall of the extension 62, i.e., the wall surface opposed to the outer wall of the rib 33 is slidable along the outer wall of the rib 33, and thus movable relative to the needle 30. The outer diameter of each of the plate part 61 and the extension 62 is set equal to or slightly smaller than the bush 52 of the stationary core 50. With the gap formation component 60, therefore, the outer wall of each of the plate part 61 and the extension 62, i.e., the wall surface opposed to the inner wall of the bush 52 is slidable along the inner wall of the bush 52. With the needle 30, therefore, the end portion on the side closer to the rib 33 is reciprocally guided in the axial direction by the stationary core 50 and the gap formation component 60.

With the needle 30 in the first embodiment, the vicinity of the end portion on the side closer to the valve seat 14 is reciprocally supported by the inner wall of the nozzle cylinder portion 11 of the nozzle 10, and a portion of the needle 30 on the side closer to the stationary core 50 is reciprocally supported by the stationary core 50 and the gap formation component 60. In this way, axial reciprocation of the needle 30 is guided by two portions in the direction of the axis Ax1 of the housing 20.

In the first embodiment, since the extension 62 has a cylindrical shape, while the extension 62 is in abutment with the movable core 40, an annular space S1 as an annular space is formed between the abutment surface 34 of the rib 33, the movable core 40, and the inner wall of the extension 62.

The gap formation component 60 further has a hole 611. The hole 611 connects a first end surface and a second end surface of the plate part 61, and can communicate with the axial hole 313 of the needle 30. As a result, the fuel in the fuel passage 100 on the side, opposite to the valve seat 14, of the gap formation component 60 can flow to the valve seat 14 side of the movable core 40 through the hole 611 and the axial holes 313 and 314 of the needle 30.

The spring 71, for example, a coil spring, is provided on the side opposite to the valve seat 14 with respect to the gap formation component 60. A first end of the spring 71 is in abutment with an end surface of the plate part 61 of the gap formation component 60 on the side opposite to the extension 62. A second end of the spring 71 is in abutment with the adjusting pipe 53. The spring 71 biases the gap formation component 60 toward the valve seat 14. While the plate part 61 of the gap formation component 60 is in abutment with the needle 30, the spring 71 can bias the needle 30 toward the valve seat 14, i.e., in a valve closing direction via the gap formation component 60. While the extension 62 of the gap formation component 60 is in abutment with the movable core 40, the spring 71 can bias the movable core 40 toward the valve seat 14 via the gap formation component 60. That is, the spring 71 can bias the needle 30 and the movable core 40 toward the valve seat 14 via the gap formation component 60. The biasing force of the spring 71 is adjusted by a position of the adjusting pipe 53 with respect to the stationary core 50.

The yoke 90 has a cylindrical shape formed of a magnetic material such as ferritic stainless steel, for example, and is subjected to magnetic stabilization treatment. The yoke 90 is provided so as to be located on a radially outer side of the housing 20, especially the second cylinder part 22. The yoke 90 has a lower-yoke protrusion 91 that annually protrudes radially inward from the end portion of the yoke 90 on the side closer to the valve seat 14. A lower-yoke stopping surface 911 is provided on the end surface of the lower-yoke protrusion 91 on the side opposite to the valve seat 14. The yoke 90 has an upper-yoke screw part 92 formed on the inner wall in the middle of the yoke 90 in the axial direction. The upper-yoke screw part 92 is provided over the entire circumferential area of the yoke 90.

A first-cylinder-part stopping surface 211 opposed to the lower-yoke stopping surface 911 is provided on the outer wall of the first cylinder part 21 of the housing 20. The third cylinder part 23 has a third-cylinder-part protrusion 231 that annually protrudes from the outer wall to the radially outer side of the third cylinder part. A third-cylinder-part screw part 232, which can be screwed with the upper-yoke screw part 92, is provided on the surface on the radially outer side of the third-cylinder-part protrusion 231.

The upper-yoke screw part 92 of the yoke 90 is screwed with the third-cylinder-part screw part 232 such that the lower-yoke stopping surface 911 abuts on the first-cylinder-part stopping surface 211. At this time, an axial force F1 along the axis Ax1 in the direction, in which the first and third cylinder parts 21 and 23 approach each other, is generated in the first and third cylinder parts 21 and 23. Hence, a contractile force in the axis Ax1 direction acts on the second cylinder part 22 forming the magnetic throttle part 221 from the first and third cylinder parts 21 and 23. The lower-yoke stopping surface 911 of the yoke 90 is stopped by the first-cylinder-part stopping surface 211 and thus limited in movement relative to the housing 20 to the side opposite to the valve seat 14.

In the first embodiment, a portion of the third-cylinder-part protrusion 231 on the side opposite to the valve seat 14 with respect to the third-cylinder-part screw part 232 is connected by welding to a portion of the yoke 90 on the side opposite to the valve seat 14 with respect to the upper-yoke screw part 92. In FIG. 1, a connection between the third-cylinder-part protrusion 231 and the yoke 90 is indicated by c5. The connection c5 has a melt w5 formed by melting, cooling, and solidification through welding of part of the third-cylinder-part protrusion 231 and part of the yoke 90. As a result, the third cylinder part 23 and the yoke 90 are fixed in a non-rotatable manner relative to each other. It is therefore possible to suppress "reduction in the axial force F1 due to relative rotation of the third cylinder part 23 and the yoke 90". The third-cylinder-part protrusion 231 forms a substantially cylindrical coil accommodation room 101 between its end surface on the side closer to the valve seat 14, the inner wall of the yoke 90, and the outer wall of the housing 20.

Figure 4:
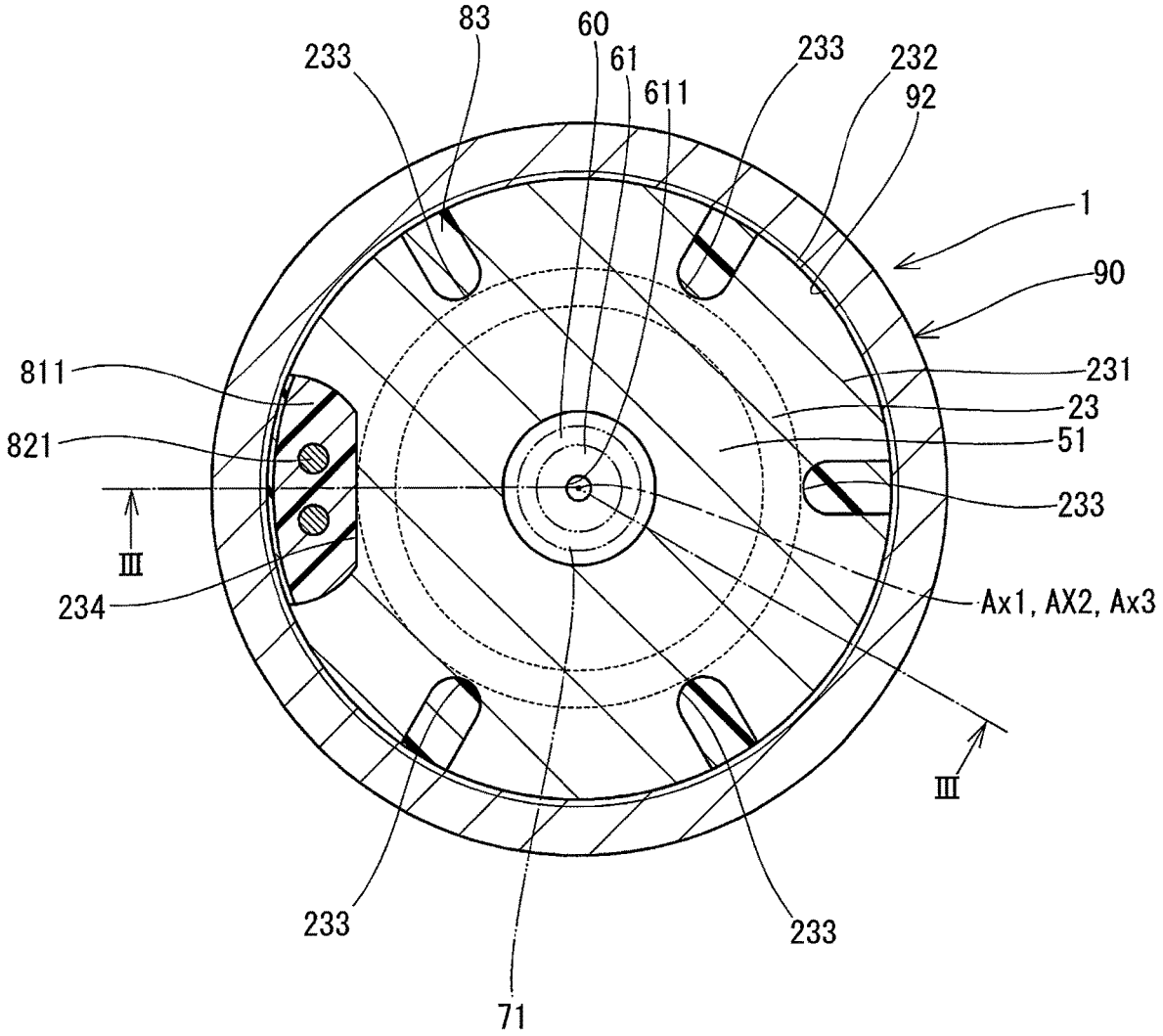
FIG. 4 is a sectional view along a line IV-IV in FIG. 3.

As shown in FIG. 4, the third-cylinder-part protrusion 231 has grooves 233 and 234. The grooves 233 and 234 are formed so as to be cut radially inward from the outer periphery of the third-cylinder-part protrusion 231. The grooves 233 and 234 are formed so as to connect the end surface on the side closer to the valve seat 14 and the end surface on the side opposite to the valve seat 14 of the third-cylinder-part protrusion 231. In the first embodiment, five grooves 233 and one groove 234 are provided. The groove 234 is larger than the groove 233. The grooves 233 and 234 are provided at substantially equal intervals in a circumferential direction of the third-cylinder-part protrusion 231. That is, the grooves 233 and 234 are provided at an interval of about 60 degrees in the circumferential direction of the third-cylinder-part protrusion 231. The grooves 233 and 234 connect a space of the third-cylinder-part protrusion 231 on the side opposite to the valve seat 14 and the coil accommodation room 101.

Figure 2:
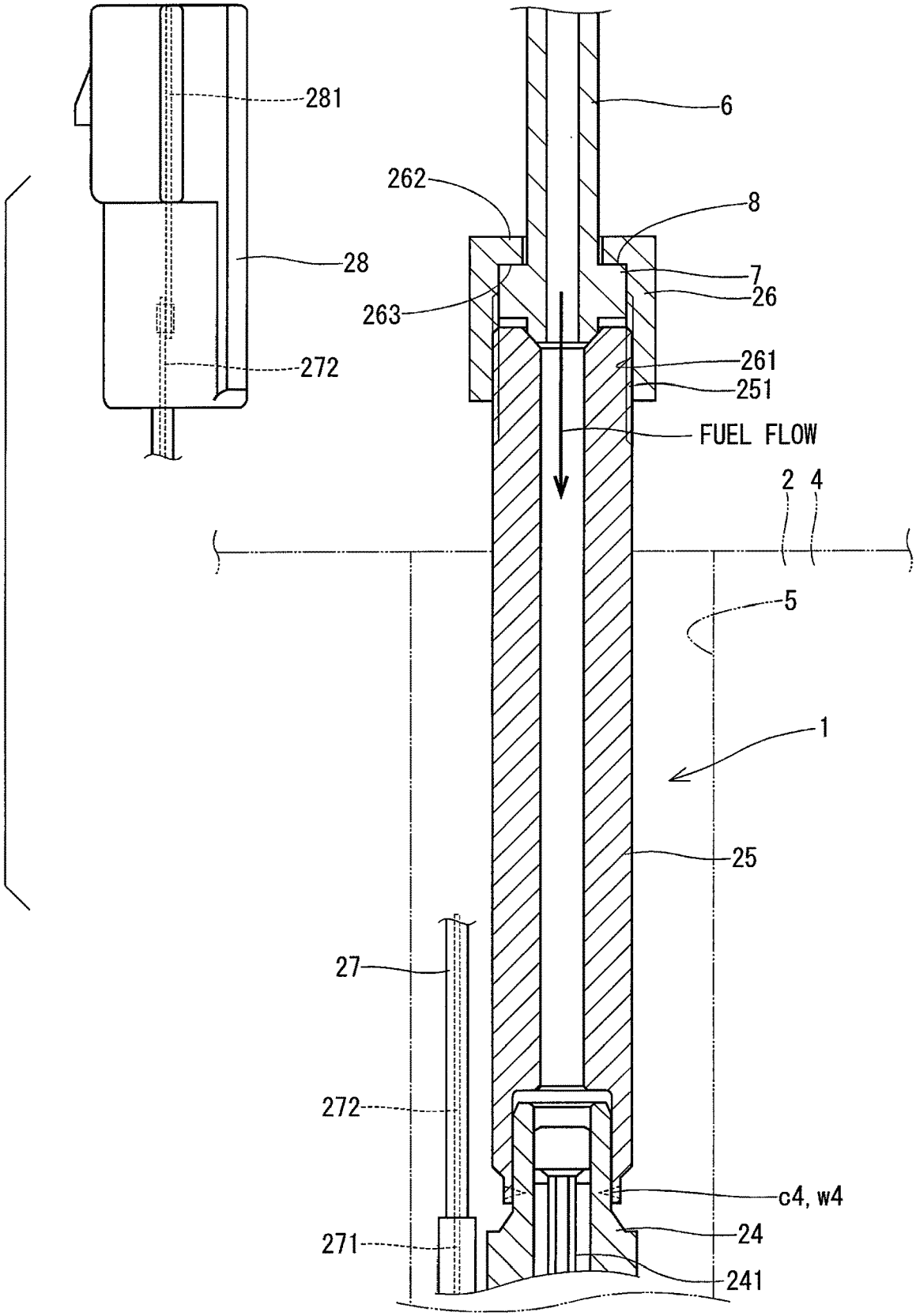
FIG. 2 is a sectional view illustrating a fuel inlet of the fuel injection device of the first embodiment of the disclosure and the vicinity of the fuel inlet.

As shown in FIGS. 1 and 2, the coil 80, having a substantially cylindrical shape, is provided in the coil accommodation room 101 so as to be located on a radially outer side of each of the connections c1 and c2 between the second cylinder part 22 and the respective first and third cylinder parts 21 and 23 in the housing 20. That is, the coil 80 is provided between the housing 20 and the yoke 90.

The coil 80 includes a bobbin 81 and a winding 82. The bobbin 81 has a cylindrical shape formed of a resin, for example. The winding 82 is made of, for example, a copper wire, and is wound on the bobbin 81. The bobbin 81 has a bobbin extension 811 that extends from a circumferential portion of the bobbin 81 in a direction parallel to the axis. Winding terminals 821 to be connected to the winding 82 are provided inside the bobbin extension 811. The end portions of the winding terminals 821 on the side opposite to the winding 82 are out of the bobbin extension 811.

The coil 80 is provided such that the bobbin extension 811 is located in the groove 234 of the third-cylinder-part protrusion 231. The coil accommodation room 101 is filled with a thermoplastic resin. As a result, the periphery of the coil 80 in the coil accommodation room 101 is covered with the resin. The grooves 233 and the outer wall of the third cylinder part 23 on the side opposite to the valve seat 14 with respect to the third-cylinder-part protrusion 231 are also covered with the resin. As a result, a mold 83 including the resin is formed over the coil accommodation room 101, the grooves 233, and the outer wall of the third cylinder part 23.

A cable 27 for connection is provided in the mold 83. The cable 27 includes a cable terminal 271 and a conductor wire 272. The cable terminal 271 is electrically connected to the winding terminals 821 within the mold 83 (see FIG. 1).

A connector 28 is provided so as to be connected to the end portion of the cable 27 on the side opposite to the mold 83. A connector terminal 281 is provided in the connector 28 by insert molding. The connector terminal 281 is electrically connected to the conductor wire 272 within the connector 28 (see FIG. 2).

When power is supplied to the winding 82 (the winding 82 is energized) via the connector terminal 281, the conductor wire 272, and the winding terminals 821, the coil 80 generates magnetic force. When the coil 80 generates the magnetic force, a magnetic circuit is formed through the first cylinder part 21, the movable core 40, the stationary core 50, the third cylinder part 23, the third-cylinder-part protrusion 231, and the yoke 90 so as to keep out of the magnetic throttle part 221 of the second cylinder part 22. As a result, a magnetic attractive force is generated between the stationary core body 51 and the movable core body 41, and the movable core 40 is attracted toward the stationary core 50. At this time, the movable core 40 moves in the valve opening direction in the axial gap CL1 while being accelerated, and collides with the abutment surface 34 of the rib 33 of the needle 30. Consequently, the needle 30 moves in the valve opening direction, and the seal part 32 separates from the valve seat 14, resulting in valve opening. As a result, the injection holes 13 are opened. In this way, the energized coil 80 can attract the movable core 40 toward the stationary core 50 to allow the stationary core 50 to abut on the rib 33 and thus move the needle 30 to the side opposite to the valve seat 14.

As described above, in the first embodiment, since the gap formation component 60 forms the axial gap CL1 between the rib 33 and the movable core 40, the movable core 40 can be accelerated in the axial gap CL1 and collided with the rib 33 during energization of the coil 80. Consequently, even if the fuel pressure in the fuel passage 100 is relatively high, the valve can be opened without increasing the power supplied to the coil 80.

When the movable core 40 is attracted toward the stationary core 50 (in the valve opening direction) by the magnetic attraction force, the surface of the magnetic core body 41 on the side closer to the stationary core 50 collides with the end surface of the bush 52 on the side closer to the valve seat 14. This limits the movement of the movable core 40 in the valve opening direction. In the first embodiment, the fuel injection device 1 further includes a spring seat part 291, a fixing part 292, a cylinder part 293, and a spring 73. The spring seat part 291 is connected to the fixing part 292 by the cylinder part 293. The spring seat part 291, the fixing part 292, and the cylinder part 293 are integrally made of a metal such as stainless steel, for example. The spring seat part 291 is formed annually, and is located on a radially outer side of the needle body 31 between the movable core 40 and the guide part 28.

The fixing part 292, having a cylindrical shape, is located on a radially outer side of the needle body 31 between the movable core 40 and the spring seat part 291. The inner wall of the fixing part 292 is fitted with the outer wall of the needle body 31 and thus fixed to the needle body 31.

The cylinder part 293 has a cylindrical shape, of which the first end is connected to the spring seat part 291 and the second end is connected to the fixing part 292. As a result, the spring seat part 291 is fixed to the radially outer side of the needle body 31 between the movable core 40 and the guide part 28.

The spring 73, for example, a coil spring, is provided such that its first end can abut on the spring seat part 291, and its second end can abut on the bottom of the recess 44 of the movable core 40. The spring 73 can bias the movable core 40 toward the stationary core 50. The biasing force of the spring 73 is smaller than that of the spring 71.

The spring 71 biases the gap formation component 60 toward the valve seat 14, thereby the plate part 61 of the gap formation component 60 abuts on the needle 30, and thus the seal part 32 of the needle 30 is pressed against the valve seat 14. At this time, the spring 73 can bias the movable core 40 toward the stationary core 50, thereby the extension 62 of the gap formation component 60 and the movable core 40 are pressed against each other and thus abut on each other. In this state, the axial gap CL1 is formed between the abutment surface 34 of the rib 33 of the needle 30 and the movable core 40.

The movable core 40 is provided so as to be able to axially reciprocate between the rib 33 of the needle 30 and the fixing part 292. The bottom of the recess 44 of the movable core 40 can abut on the end portion of the fixing part 292 on the side closer to the movable core 40. Such abutment of the fixing part 292 with the movable core 40 can limit movement of the movable core 40 relative to the needle 30 toward the valve seat 14.

In the first embodiment, a cylindrical space S2 is provided between the cylinder part 293, the spring seat part 291, and the needle body 31. The radial hole 314 of the needle 30 is in communication with the cylindrical space S2. Consequently, the fuel in the axial hole 313 can flow toward the valve seat 14 through the radial hole 314, the cylindrical space S2, and a channel part 282.

In the first embodiment, if energization of the coil 80 is stopped while the movable core 40 is attracted toward the stationary core 50, the needle 30 and the movable core 40 are biased toward the valve seat 14 by the biasing force of the spring 71 via the gap formation component 60. Consequently, the needle 30 moves in the valve closing direction, and the seal part 32 abuts on the valve seat 14, resulting in valve closing. As a result, the injection holes 13 are closed.

After the seal part 32 abuts on the valve seat 14, the movable core 40 inertially moves relative to the needle 30 toward the valve seat 14. At this time, the fixing part 292 can limit excessive movement of the movable core 40 toward the valve seat 14 by abutting on the movable core 40. This makes it possible to suppress a reduction in response at subsequent valve opening. In addition, the biasing force of the spring 73 can reduce the impact at abutment of the movable core 40 with the fixing part 292, making it possible to suppress secondary valve opening due to bounce of the needle 30 on the valve seat 14. Furthermore, the fixing part 292 limits movement of the movable core 40 toward the valve seat 14, which suppresses excessive compression of the spring 73. In addition, this suppresses secondary valve opening occurring in such a manner that the movable core 40 is biased in the valve opening direction by the restoring force of the excessively compressed spring 73, and thus collides with the rib 33 again, leading to valve opening.

The influent fuel from the cylindrical component 25 and the inlet part 24 flows through the stationary core 50, the adjusting pipe 53, the hole 611 of the gap formation component 60, the axial and radial holes 313 and 314 of the needle 30, the radial hole 314, the cylindrical space S2, between the first cylinder part 21 and the needle 30, and between the nozzle 10 and the needle 30, i.e., through the fuel passage 100, and is guided to the injection holes 13.

As shown in FIGS. 1 and 2, in the first embodiment, the fuel injection device 1 is attached in an attachment hole 5 formed in an engine head 4 of the engine 2 such that the nozzle bottom 12 of the nozzle 10 is exposed to a combustion room 3 of the engine 2. The fuel injection device 1 is attached such that a surface of the lower-yoke protrusion 91 of the yoke 90 on the side opposite to the lower-yoke stopping surface 911 is pressed against a stepped surface of the attachment hole 5. At this time, although an axial force in the direction, in which the first and third cylinder parts 21 and 23 approach each other, is generated in the first and third cylinder parts 21 and 23, such an axial force is smaller than the axial force F1 generated by the screwing between the yoke 90 and the third cylinder part 23.

A method of manufacturing the fuel injection device 1 of the first embodiment is now described.

The method of manufacturing the fuel injection device 1 of the first embodiment includes the following steps.

(Housing Welding Step)

While the needle 30, the movable core 40, and the like are accommodated within the housing 20, the second cylinder part 22 is welded to each of the first and third cylinder parts 21 and 23.

(Coil Assembling Step)

The coil 80 is assembled onto the outer side of the housing 20 such that the bobbin extension 811 is located in the groove 234.

(Yoke Assembling Step)

The lower-yoke stopping surface 911 is allowed to abut on the first-cylinder-part stopping surface 211, and the upper-yoke screw part 92 is screwed with the third-cylinder-part screw part 232, and thus the yoke 90 is assembled in the housing 20 such that the axial force F1 having a predetermined magnitude in the direction, in which the first and third cylinder parts 21 and 23 approach each other, is generated in the first and third cylinder parts 21 and 23.

(Yoke Welding Step)

The connection c5 between the third-cylinder-part protrusion 231 and the yoke 90 is formed by welding. At this time, a portion of the third-cylinder-part protrusion 231, which is on the side opposite to the valve seat 14 with respect to the third-cylinder-part screw part 232, is welded to a portion of the yoke 90 on the side opposite to the valve seat 14 with respect to the upper-yoke screw part 92. It is therefore possible to suppress "the reduction in the axial force F1 due to elongation of the yoke 90 in the axial direction during welding".

(Molding Step)

The coil accommodation room 101 is filled with a heated thermoplastic resin through the grooves 233, and the outer wall of the third cylinder part 23 is covered with the heated thermoplastic resin, so that the mold 83 is formed.

Operation of the fuel injection device 1 of the first embodiment is now described.

As shown in FIGS. 1 and 3, when the coil 80 is not energized, the seal part 32 of the needle 30 is in abutment with the valve seat 14, the plate part 61 of the gap formation component 60 is in abutment with the needle 30, and the extension 62 is in abutment with the movable core 40. At this time, the axial gap CL1 exists between the abutment surface 34 of the rib 33 and the movable core 40.

When the coil 80 is energized in the state as shown in FIGS. 1 and 3, the movable core 40 is attracted toward the stationary core 50, and moves toward the stationary core 50 as the movable core 40 is accelerated in the axial gap CL1 while raising the gap formation component 60. The movable core 40, which is accelerated in the axial gap CL1 and thus increased in kinetic energy, collides with the abutment surface 34 of the rib 33. Consequently, the seal part 32 separates from the valve seat 14, resulting in valve opening.

The movable core 40 collides with the rib 33, and then further moves toward the stationary core 50 and abuts on the bush 52. This limits movement in the valve opening direction of the movable core 40. At this time, the needle 30 further moves inertially in the valve opening direction, and abuts on the plate part 61 of the gap formation component 60.

When energization of the coil 80 is stopped, the movable core 40 and the needle 30 move in the valve closing direction by the biasing force of the spring 71 via the gap formation component 60. When the seal part 32 of the needle 30 abuts on the valve seat 14 and the valve is closed, the movable core 40 further moves inertially in the valve closing direction and abuts on the fixing part 292. This limits movement of the movable core 40 in the valve closing direction. At this time, the movable core 40 is away from the extension 62 of the gap formation component 60. Subsequently, the movable core 40 moves in the valve opening direction by the biasing force of the spring 73, and abuts on the extension 62 of the gap formation component 60 (see FIGS. 1 and 3).

As described above, in the first embodiment, the nozzle 10 has the injection holes 13 to inject fuel and the valve seat 14 formed annually around the injection holes 13. The housing 20 includes the first cylinder part 21 having a first end connected to the nozzle 10, the second cylinder part 22 having a first end connected to a second end of the first cylinder part 21 and forming the magnetic throttle part 221 in at least a part of the second cylinder part 22 in the axial direction, the third cylinder part 23 having one end connected to a second end of the second cylinder part 22, and the fuel passage 100 formed inside the first, second, and third cylinder parts 21, 22, and 23 so as to communicate with the injection holes 13 and guide the fuel to the injection holes 13.

The needle 30 includes the rod-like needle body 31 and the seal part 32 annually formed at one end of the needle body 31 so as to be able to abut on the valve seat 14, and opens and closes the injection holes 13 as the seal part 32 separates from or abuts on the valve seat 14. The movable core 40 is provided so as to be able to reciprocate together with the needle 30 within the housing 20. The stationary core 50 is provided on the side opposite to the valve seat 14 with respect to the movable core 40 inside the second and third cylinder parts 22 and 23. The spring 71 can bias the needle 30 and the movable core 40 toward the valve seat 14.

The yoke 90 has a cylindrical shape, of which the first end side is connected to the first cylinder part 21 and the second end side is connected to the third cylinder part 23, and is provided on a radially outer side of the housing 20 such that the axial force F1 in the direction, in which the first and third cylinder parts 21 and 23 approach each other, is generated in the first and third cylinder parts 21 and 23.

The coil 80 is provided between the housing 20 and the yoke 90, and is energized to be able to form a magnetic circuit through the first cylinder part 21, the movable core 40, the stationary core 50, the third cylinder part 23, and the yoke 90, and thus able to attract the movable core 40 toward the stationary core 50 and move the needle 30 to the side opposite to the valve seat 14.

In the first embodiment, the yoke 90 is provided such that the axial force F1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23. As a result, even if the fuel pressure in the fuel passage 100 increases, it is possible to suppress "a force by which the components separate from each other in the axis Ax1 direction", which acts on the connection c1 between the second and first cylinder parts 22 and 21, the connection c2 between the second and third cylinder parts 22 and 23, or the magnetic throttle part 221. It is therefore possible to suppress stress concentration on the connection c1 between the second and first cylinder parts 22 and 21, the connection c2 between the second and third cylinder parts 22 and 23, or the magnetic throttle part 221, and suppress break caused by the stress concentration. Consequently, in the first embodiment, high-pressure fuel can be injected while fuel leakage is suppressed.

In the first embodiment, since the contractile force in the axis Ax1 direction acts on the second cylinder part 22 forming the magnetic throttle part 221 from the first and third cylinder parts 21 and 23, even if the fuel pressure in the fuel passage 100 increases, it is possible to suppress shift of the position of the magnetic throttle part 221 in the Ax1 direction with respect to the stationary core 50. It is therefore possible to suppress a variation in the magnitude of the magnetic attraction force generated between the stationary core 50 and the movable core 40. This makes it possible to suppress a reduction in fuel injection accuracy.

As described above, the fuel injection device 1 of the first embodiment can accurately inject the high-pressure fuel while suppressing fuel leakage.

In the first embodiment, the first cylinder part 21 has the first-cylinder-part stopping surface 211. The third cylinder part 23 has the third-cylinder-part screw part 232. The yoke 90 has the lower-yoke stopping surface 911 that is stopped by the first-cylinder-part stopping surface 211 and thus limited in movement relative to the housing 20 to the side opposite to the valve seat 14, and has the upper-yoke screw part 92 screwed with the third-cylinder-part screw part 232. In the first embodiment, the third cylinder part 23 and the yoke 90 are fixed in a non-rotatable manner relative to each other. It is therefore possible to suppress "reduction in the axial force F1 due to relative rotation of the third cylinder part 23 and the yoke 90".

In the first embodiment, the third cylinder part 23 has the third-cylinder-part protrusion 231, which annually protrudes from the outer wall of the third cylinder part to the radially outer side on the side opposite to the valve seat 14 with respect to the coil 80 while having the third-cylinder-part screw part 232 on the surface of the third-cylinder-part protrusion on the radially outer side. The third cylinder part 23 is integrally formed with the stationary core 50. This reduces the number of components and the number of assembling.

The needle 30 has the abutment surface 34 that can abut on the surface of the movable core 40 on the side closer to the stationary core 50. The movable core 40 is provided so as to be movable relative to the needle 30 such that the movable core 40 can abut on or separate from the abutment surface 34. The gap formation component 60 that can form the axial gap CL1 is provided between the abutment surface 34 and the movable core 40. This allows the movable core 40 to be accelerated in the axial gap CL1 and collide with the rib 33 during energization of the coil 80. Consequently, even if the fuel pressure in the fuel passage 100 is relatively high, the valve can be opened without increasing the power supplied to the coil 80.

The fuel injection device 1 of the first embodiment receives the fuel from the outside through the fuel pipe 6. The inlet part 24 and the cylindrical component 25 collectively act as the fuel inlet, and each has a cylindrical shape. The inlet part 24 on a first end side of the fuel inlet is connected to the second end of the third cylinder part 23, and the cylindrical component 25 on a second end side of the fuel inlet is connected to the fuel pipe 6, so that the fuel is guided from the outside to the fuel passage 100.

The screw coupling component 26 is screwed with the cylindrical component 25 such that the cylindrical component 25 is closely in contact with the fuel pipe 6. This makes it possible to supply high-pressure fuel into the fuel passage 100 through the cylindrical component 25 and the inlet part 24.

Second Embodiment

Figure 5:
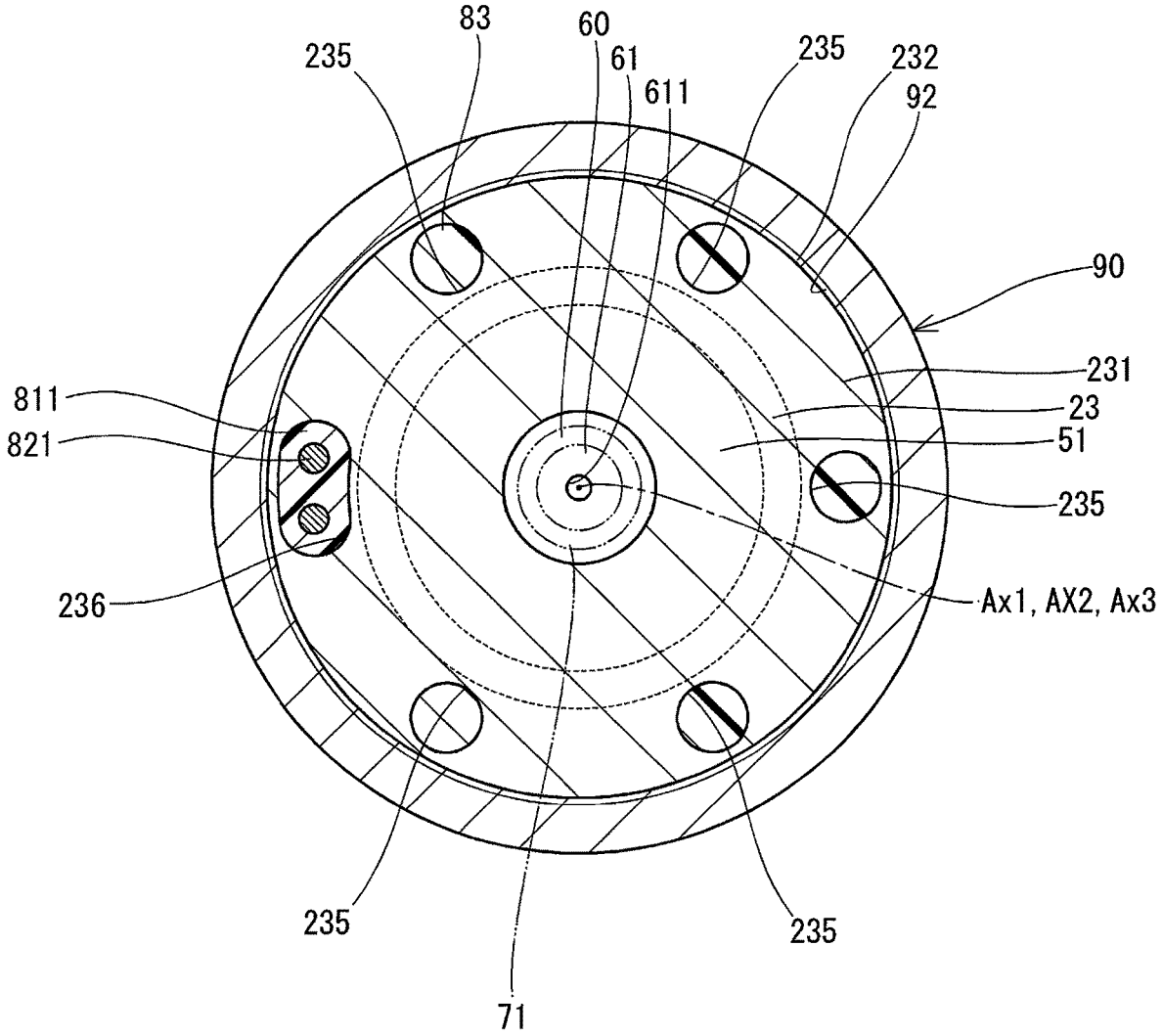
FIG. 5 is a sectional view illustrating a third cylinder part protrusion of a fuel injection device of a second embodiment of the disclosure and the vicinity of the protrusion.

FIG. 5 illustrates part of a fuel injection device of a second embodiment of the present disclosure. The second embodiment is different from the first embodiment in a configuration of the third-cylinder-part protrusion 231.

In the second embodiment, the third-cylinder-part protrusion 231 has holes 235 and 236 in place of the grooves 233 and 234 described in the first embodiment. The holes 235 and 236 are formed so as to connect the end surface on the side closer to the valve seat 14 and the end surface on the side opposite to the valve seat 14 of the third-cylinder-part protrusion 231 on the radially inner side of the third-cylinder-part screw part 232. In the second embodiment, five holes 235 are provided in the circumferential direction of the third-cylinder-part protrusion 231 such that each hole has a circular shape as seen from the axis Ax1 direction. One hole 236 is provided so as to have an elliptic shape along an arc as seen from the axis Ax1 direction. The hole 236 is larger than the hole 235. The holes 235 and 236 are provided at substantially equal intervals in the circumferential direction of the third-cylinder-part protrusion 231. That is, the holes 235 and 236 are provided at an interval of about 60 degrees in the circumferential direction of the third-cylinder-part protrusion 231. The holes 235 and 236 connect a space of the third-cylinder-part protrusion 231 on the side opposite to the valve seat 14 and the coil accommodation room 101.

The bobbin extension 811 runs through the hole 236.

A method of manufacturing the fuel injection device of the second embodiment is now described.

As described below, the method of manufacturing the fuel injection device of the second embodiment is different in the coil assembling step and the molding step from that of the first embodiment.

(Coil Assembling Step)

The coil 80 is assembled onto the outer side of the housing 20 such that the bobbin extension 811 runs through the hole 236.

(Molding Step)

The coil accommodation room 101 is filled with a heated thermoplastic resin through the holes 235, and the outer wall of the third cylinder part 23 is covered with the heated thermoplastic resin, so that the mold 83 is formed.

As described above, in the second embodiment, the third-cylinder-part protrusion 231 forms the coil accommodation room 101 accommodating the coil 80 between its end surface on the side closer to the valve seat 14, the inner wall of the yoke 90, and the outer wall of the housing 20, and has the holes 235 and 236 that connect the end surface on the side closer to the valve seat 14 and the end surface on the side opposite to the valve seat 14 of the third-cylinder-part protrusion on the radially inner side of the third-cylinder-part screw part 232. The periphery of the coil 80 in the coil accommodation room 101 is covered with the resin.

In the second embodiment, the holes 235 and 236 are provided on the radially inner side of the third-cylinder-part screw part 232 on the third-cylinder-part protrusion 231. Hence, the third-cylinder-part screw part 232 is formed continuously over the entire circumferential area of the third-cylinder-part protrusion 231 without any cutout partially formed in the circumferential direction unlike the first embodiment. Hence, the axial force F1 in the direction, in which the first and third cylinder parts 21 and 23 approach each other, can be made uniform over the entire circumferential area of the third-cylinder-part screw part 232. In the second embodiment, the hole 235 has a circular shape, and the hole 236 has an elliptic shape. Hence, the holes 235 and 236 can be easily formed with a drill, for example.

Third Embodiment

Figure 6:
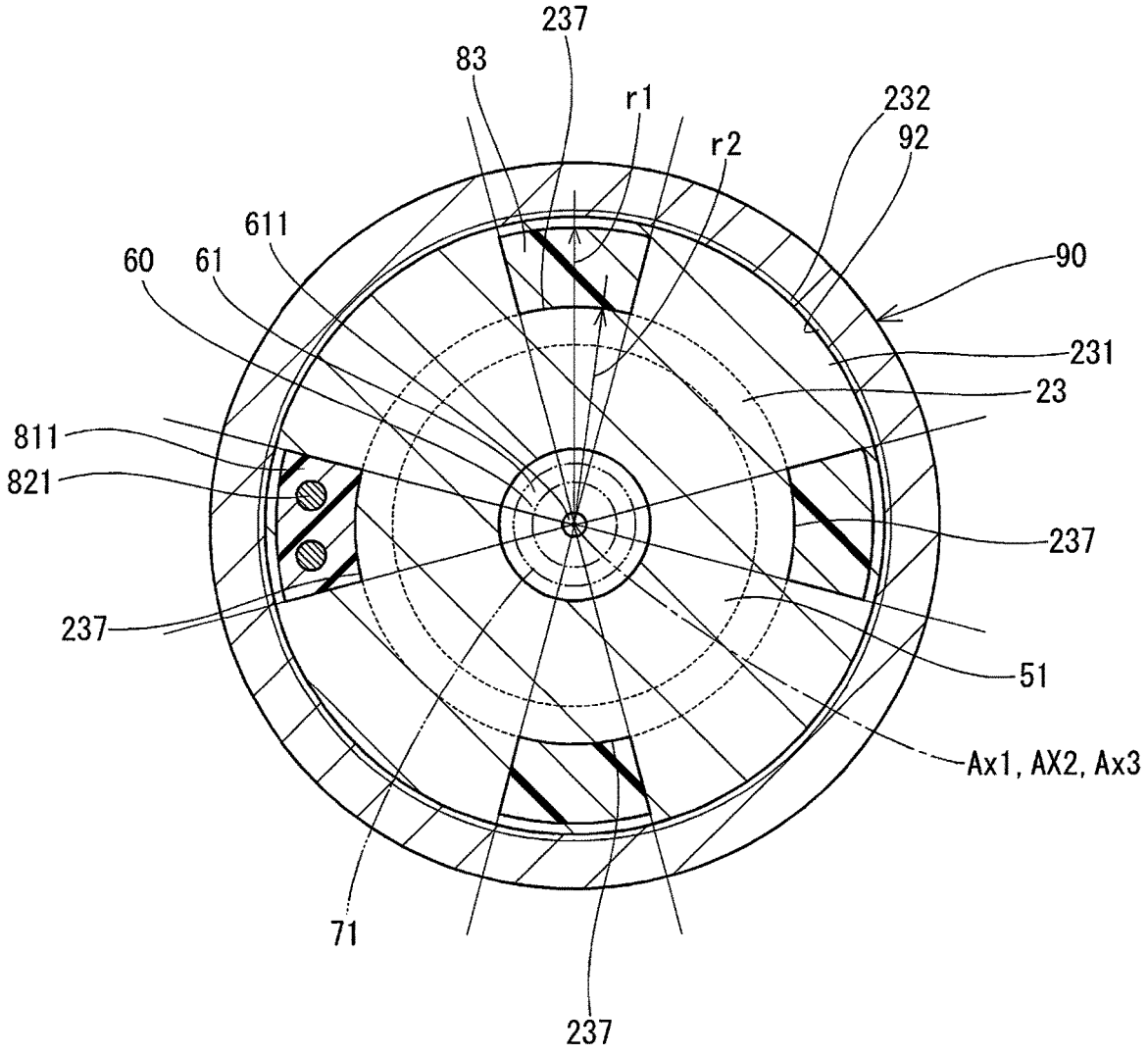
FIG. 6 is a sectional view illustrating a third cylinder part protrusion of a fuel injection device of a third embodiment of the disclosure and the vicinity of the protrusion.

FIG. 6 illustrates part of a fuel injection device of a third embodiment of the present disclosure. The third embodiment is different from the second embodiment in a configuration of the third-cylinder-part protrusion 231.

In the third embodiment, the third-cylinder-part protrusion 231 has holes 237 in place of the holes 235 and 236 described in the second embodiment. The holes 237 are formed so as to connect the end surface on the side closer to the valve seat 14 and the end surface on the side opposite to the valve seat 14 of the third-cylinder-part protrusion 231 on the radially inner side of the third-cylinder-part screw part 232. In the third embodiment, four holes 237 are provided in the circumferential direction of the third-cylinder-part protrusion 231 such that each hole has a shape given by removing a sector having a radius r2 from a sector having a radius r1 as seen from the axis Ax1 direction. The radius r1 is smaller than the radius of the third-cylinder-part protrusion 231 and larger than the radius r2 (see FIG. 6). The radius r2 is equal to half the outer diameter of the third cylinder part 23 having the cylindrical shape.

The holes 237 are provided at substantially equal intervals in the circumferential direction of the third-cylinder-part protrusion 231. That is, the holes 237 are provided at an interval of about 90 degrees in the circumferential direction of the third-cylinder-part protrusion 231. The holes 237 connect a space of the third-cylinder-part protrusion 231 on the side opposite to the valve seat 14 and the coil accommodation room 101. The bobbin extension 811 runs through one of the four holes 237.

A method of manufacturing the fuel injection device of the third embodiment is now described.

As described below, the method of manufacturing the fuel injection device of the third embodiment is different in the coil assembling step and the molding step from that of the second embodiment.

(Coil Assembling Step)

The coil 80 is assembled onto the outer side of the housing 20 such that the bobbin extension 811 runs through the hole 237.

(Molding Step)

The coil accommodation room 101 is filled with a heated thermoplastic resin through the holes 237, and the outer wall of the third cylinder part 23 is covered with the heated thermoplastic resin, so that the mold 83 is formed.

As described above, in the third embodiment, the third-cylinder-part protrusion 231 forms the coil accommodation room 101 accommodating the coil 80 between its end surface on the side closer to the valve seat 14, the inner wall of the yoke 90, and the outer wall of the housing 20, and has the holes 237 that connect the end surface on the side closer to the valve seat 14 and the end surface on the side opposite to the valve seat 14 of the third-cylinder-part protrusion 231 on the radially inner side of the third-cylinder-part screw part 232. The periphery of the coil 80 in the coil accommodation room 101 is covered with the resin.

In the third embodiment, the holes 237 are provided on the radially inner side of the third-cylinder-part screw part 232 on the third-cylinder-part protrusion 231. Hence, the third-cylinder-part screw part 232 is formed continuously over the entire circumferential area of the third-cylinder-part protrusion 231 without any cutout partially formed in the circumferential direction unlike the first embodiment. Hence, the axial force F1 in the direction, in which the first and third cylinder parts 21 and 23 approach each other, can be made uniform over the entire circumferential area of the third-cylinder-part screw part 232, as in the second embodiment.

In the third embodiment, the four holes 237 have the same shape, and are provided at equal intervals in the circumferential direction of the third-cylinder-part protrusion 231. Hence, a balance of the magnetic circuit, which is formed in the yoke 90 during energization of the coil 80, can be improved in the circumferential direction of the third-cylinder-part protrusion 231.

Fourth Embodiment

Figure 7:
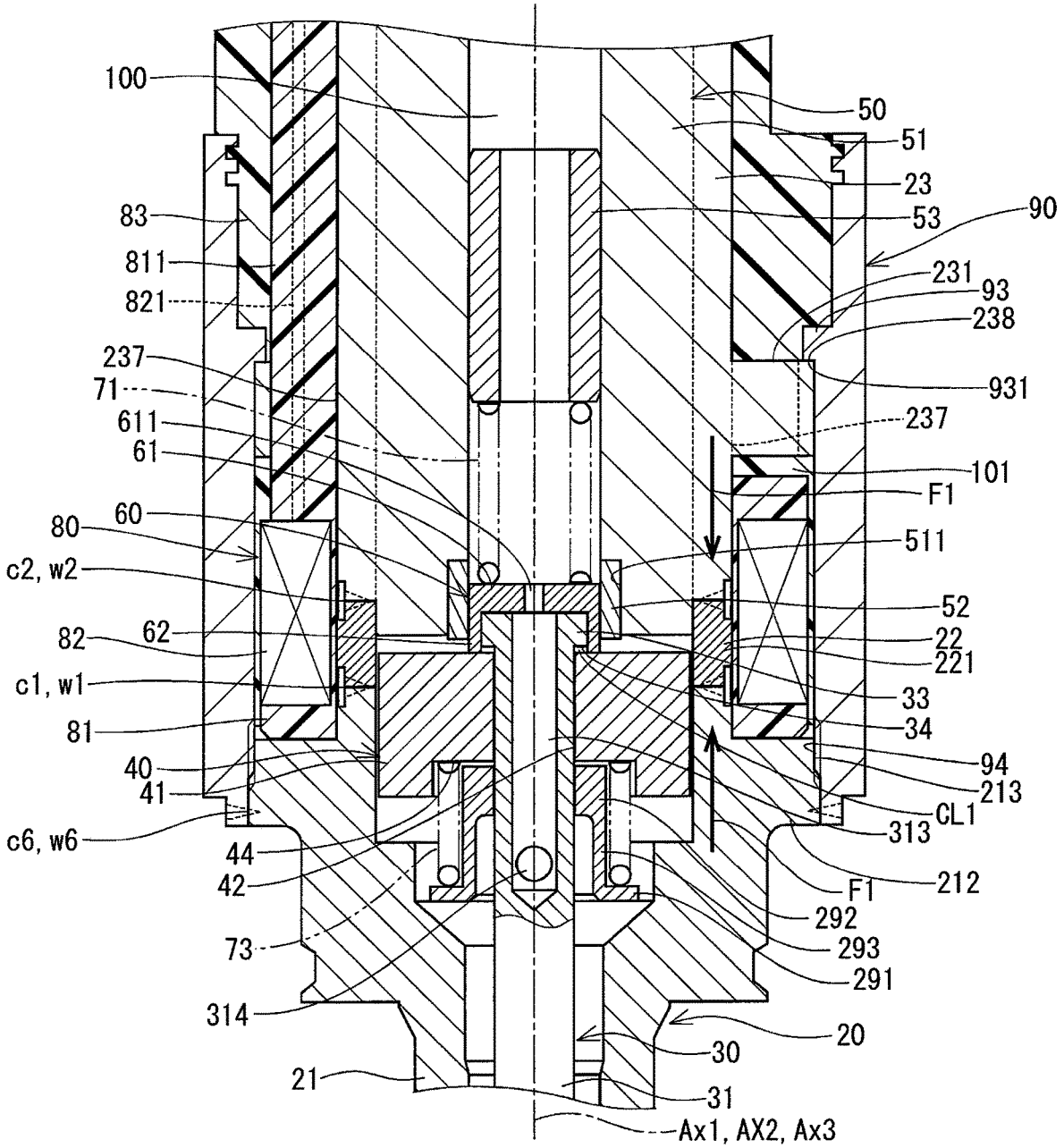
FIG. 7 is a sectional view illustrating a yoke of a fuel injection device of a fourth embodiment of the disclosure and the vicinity of the yoke.

FIG. 7 illustrates part of a fuel injection device of a fourth embodiment of the present disclosure. The fourth embodiment is different from the third embodiment specifically in configurations of the first cylinder part 21, the third cylinder part 23, and the yoke 90.

In the fourth embodiment, the first cylinder part 21 has a first-cylinder-part protrusion 212 that annually protrudes from the outer wall of the first cylinder part to the radially outer side. A first-cylinder-part screw part 213 is provided on the surface on the radially outer side of the first-cylinder-part protrusion 212.

The third-cylinder-part protrusion 231 does not have the third-cylinder-part screw part 232 described in the third embodiment. The third-cylinder-part protrusion 231 has a third-cylinder-part stopping surface 238 in the peripheral portion of its end surface on the side opposite to the valve seat 14. The holes 237 are provided on the radially inner side of the third-cylinder-part stopping surface 238.

The yoke 90 has an upper-yoke protrusion 93 that annually protrudes to a radially inner side from the inner wall in the middle of the yoke in the axial direction. An upper-yoke stopping surface 931 opposed to the third-cylinder-part stopping surface 238 is provided in the surface of the upper-yoke protrusion 93 on the side closer to the valve seat 14. The yoke 90 has a lower-yoke screw part 94, which is formed on an inner wall of the end portion of the yoke 90 on the side closer to the valve seat 14 and can be screwed with the first-cylinder-part screw part 213.

The lower-yoke screw part 94 of the yoke 90 is screwed with the first-cylinder-part screw part 213 such that the upper-yoke stopping surface 931 abuts on the third-cylinder-part stopping surface 238. In this state, the axial force F1 along the axis Ax1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23. The upper-yoke stopping surface 931 of the yoke 90 is stopped by the third-cylinder-part stopping surface 238 and thus limited in movement relative to the housing 20 toward the valve seat 14.

In the fourth embodiment, a portion of the first-cylinder-part protrusion 212 on the side closer to the valve seat 14 with respect to the first-cylinder-part screw part 213 is connected by welding to a portion of the yoke 90 on the side closer to the valve seat 14 with respect to the lower-yoke screw part 94. In FIG. 7, a connection between the first-cylinder-part protrusion 212 and the yoke 90 is indicated by c6. The connection c6 has a melt w6 formed by melting, cooling, and solidification through welding of part of the first-cylinder-part protrusion 212 and part of the yoke 90. As a result, the first cylinder part 21 and the yoke 90 are fixed in a non-rotatable manner relative to each other. It is therefore possible to suppress "reduction in the axial force F1 due to relative rotation of the first cylinder part 21 and the yoke 90".

A method of manufacturing the fuel injection device of the fourth embodiment is now described.

As described below, the method of manufacturing the fuel injection device of the fourth embodiment is different in the yoke assembling step and the yoke welding step from that of the third embodiment.

(Yoke Assembling Step)

The upper-yoke stopping surface 931 is allowed to abut on the third-cylinder-part stopping surface 238, and the lower-yoke screw part 94 is screwed with the first-cylinder-part screw part 213, and thus the yoke 90 is assembled in the housing 20 such that the axial force F1 having a predetermined magnitude is generated in the first and third cylinder parts 21 and 23 in the direction in which the first and third cylinder parts 21 and 23 approach each other.

(Yoke Welding Step)

The connection c6 between the first-cylinder-part protrusion 212 and the yoke 90 is formed by welding. At this time, a portion of the first-cylinder-part protrusion 212, which is on the side closer to the valve seat 14 with respect to the first-cylinder-part screw part 213, is welded to a portion of the yoke 90 on the side closer to the valve seat 14 with respect to the lower-yoke screw part 94. It is therefore possible to suppress "the reduction in the axial force F1 due to elongation of the yoke 90 in the axial direction during welding".

As described above, in the fourth embodiment, the first cylinder part 21 has the first-cylinder-part screw part 213. The third cylinder part 23 has the third-cylinder-part stopping surface 238. The yoke 90 has the upper-yoke stopping surface 931 that is stopped by the third-cylinder-part stopping surface 238 and thus limited in movement relative to the housing 20 to the side closer to the valve seat 14, and has the lower-yoke screw part 94 screwed with the first-cylinder-part screw part 213. The first cylinder part 21 and the yoke 90 are fixed in a non-rotatable manner relative to each other. It is therefore possible to suppress "the reduction in the axial force F1 due to relative rotation of the first cylinder part 21 and the yoke 90".

In the fourth embodiment, the third cylinder part 23 has the third-cylinder-part protrusion 231 that annually protrudes from the outer wall of the third cylinder part to the radially outer side on the side opposite to the valve seat 14 with respect to the coil 80 and has the third-cylinder-part stopping surface 238 in the end surface of the third cylinder part on the side opposite to the valve seat 14. The third-cylinder-part protrusion 231 forms the coil accommodation room 101 accommodating the coil 80 between its end surface on the side closer to the valve seat 14, the inner wall of the yoke 90, and the outer wall of the housing 20, and has the holes 237 that connect the end surface on the side closer to the valve seat 14 and the end surface on the side opposite to the valve seat 14 of the third-cylinder-part protrusion on the radially inner side of the third-cylinder-part stopping surface 238. The periphery of the coil 80 in the coil accommodation room 101 is covered with a resin.

In the fourth embodiment, the holes 237 are provided on the radially inner side of the third-cylinder-part stopping surface 238 of the third-cylinder-part protrusion 231. Hence, the third-cylinder-part stopping surface 238 is formed continuously over the entire circumferential area of the third-cylinder-part protrusion 231 without any cutout partially formed in the circumferential direction. Hence, the axial force F1 in the direction, in which the first and third cylinder parts 21 and 23 approach each other, can be made uniform over the entire circumferential area of the third-cylinder-part stopping surface 238.

Fifth Embodiment

Figure 8:
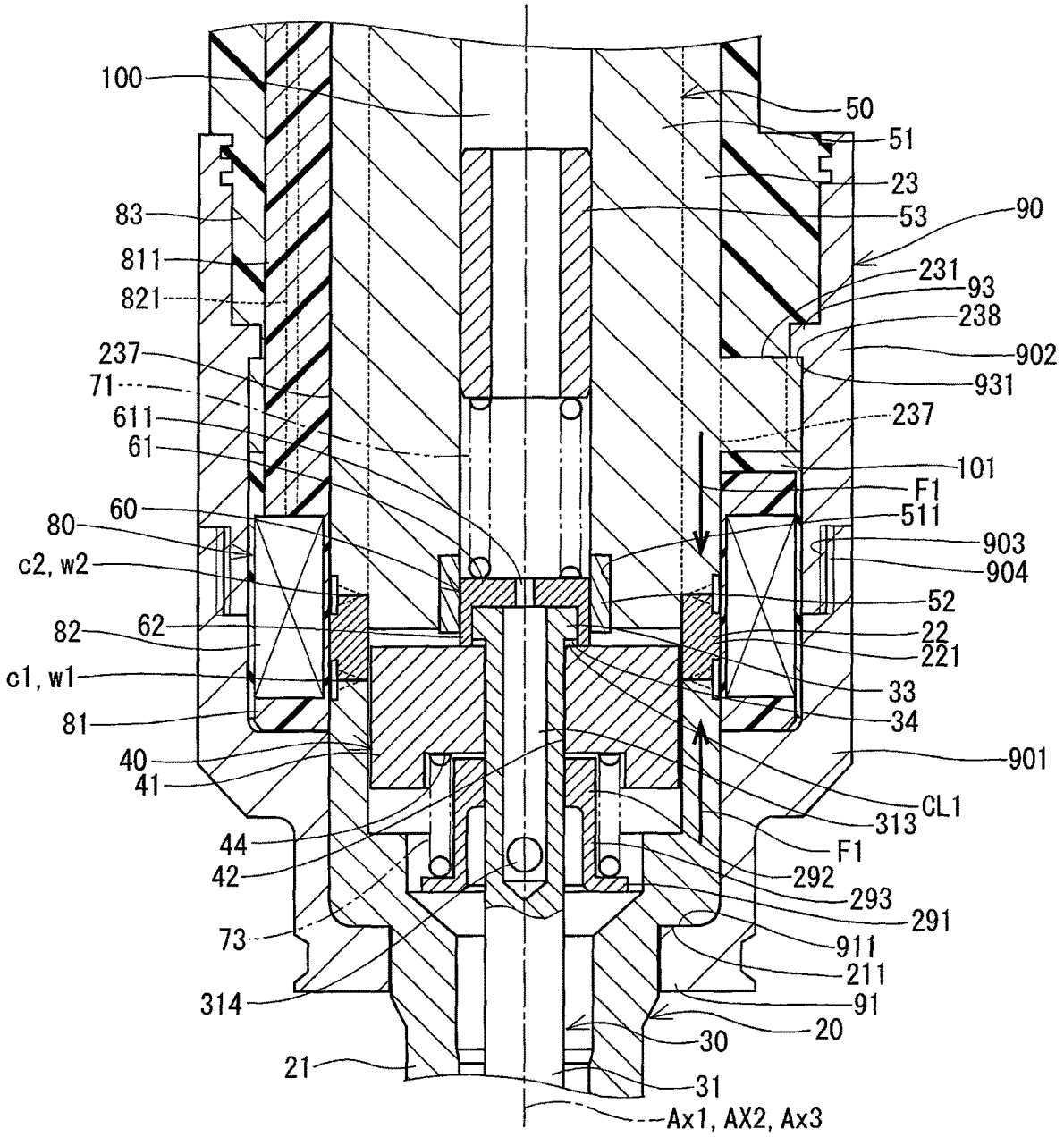
FIG. 8 is a sectional view illustrating a yoke of a fuel injection device of a fifth embodiment of the disclosure and the vicinity of the yoke.

FIG. 8 illustrates part of a fuel injection device of a fifth embodiment of the present disclosure. The fifth embodiment is different from the fourth embodiment specifically in configurations of the first cylinder part 21 and the yoke 90.

In the fifth embodiment, the first-cylinder-part stopping surface 211 is provided on the outer wall of the first cylinder part 21 of the housing 20, as in the first embodiment. The yoke 90 includes a first yoke 901 and a second yoke 902. The first and second yokes 901 and 902, each having a cylindrical shape, are provided so as to be coaxial with each other. The first yoke 901 has the lower-yoke stopping surface 911 that is stopped by the first-cylinder-part stopping surface 211 and thus limited in movement relative to the housing 20 to the side opposite to the valve seat 14.

The second yoke 902 is provided on the side opposite to the valve seat 14 with respect to the first yoke 901, and has the upper-yoke stopping surface 931 that is stopped by the third-cylinder-part stopping surface 238 of the third-cylinder-part protrusion 231 and is thus limited in movement relative to the housing 20 toward the valve seat 14.

The first yoke 901 has a first yoke screw part 903 on its inner wall of the end portion on the side opposite to the valve seat 14. The second yoke 902 has a second yoke screw part 904, which can be screwed with the first yoke screw part 903 on its outer wall of the end portion on the side closer to the valve seat 14.

The first yoke screw part 903 and the second yoke screw part 904 of the yoke 90 are screwed with each other such that the lower-yoke stopping surface 911 abuts on the first-cylinder-part stopping surface 211, and the upper-yoke stopping surface 931 abuts on the third-cylinder-part stopping surface 238. The axial force F1 along the axis Ax1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23.

The lower-yoke stopping surface 911 of the yoke 90 is stopped by the first-cylinder-part stopping surface 211 and thus limited in movement relative to the housing 20 to the side opposite to the valve seat 14. The upper-yoke stopping surface 931 of the yoke 90 is stopped by the third-cylinder-part stopping surface 238 and thus limited in movement relative to the housing 20 toward the valve seat 14.

A method of manufacturing the fuel injection device of the fifth embodiment is now described.

As described below, the method of manufacturing the fuel injection device of the fifth embodiment is different in the yoke assembling step from that of the fourth embodiment. The method of manufacturing the fuel injection device of the fifth embodiment does not include the yoke welding step as described in the fourth embodiment.

(Yoke Assembling Step)

The lower-yoke stopping surface 911 of the first yoke 901 is allowed to abut on the first-cylinder-part stopping surface 211, the upper-yoke stopping surface 931 of the second yoke 902 is allowed to abut on the third-cylinder-part stopping surface 228, and the first yoke screw part 903 is screwed with the second yoke screw part 904, and thus the yoke 90 is assembled in the housing 20 such that the axial force F1 having a predetermined magnitude is generated in the first and third cylinder parts 21 and 23 in the direction in which the first and third cylinder parts 21 and 23 approach each other.

As described above, in the fifth embodiment, the first cylinder part 21 has the first-cylinder-part stopping surface 211. The third cylinder part 23 has the third-cylinder-part stopping surface 238. The yoke 90 has the lower-yoke stopping surface 911 that is stopped by the first-cylinder-part stopping surface 211 and thus limited in movement relative to the housing 20 to the side opposite to the valve seat 14, and the upper-yoke stopping surface 931 that is stopped by the third-cylinder-part stopping surface 238 and thus limited in movement relative to the housing 20 toward the valve seat 14.

In the fifth embodiment, the yoke 90 includes the first yoke 901 having the lower-yoke stopping surface 911, and the second yoke 902 having the upper-yoke stopping surface 931. The first yoke 901 has the first yoke screw part 903 on its inner wall. The second yoke 902 has the second yoke screw part 904, which is screwed with the first yoke screw part 903, on its outer wall.

Sixth Embodiment

Figure 9:
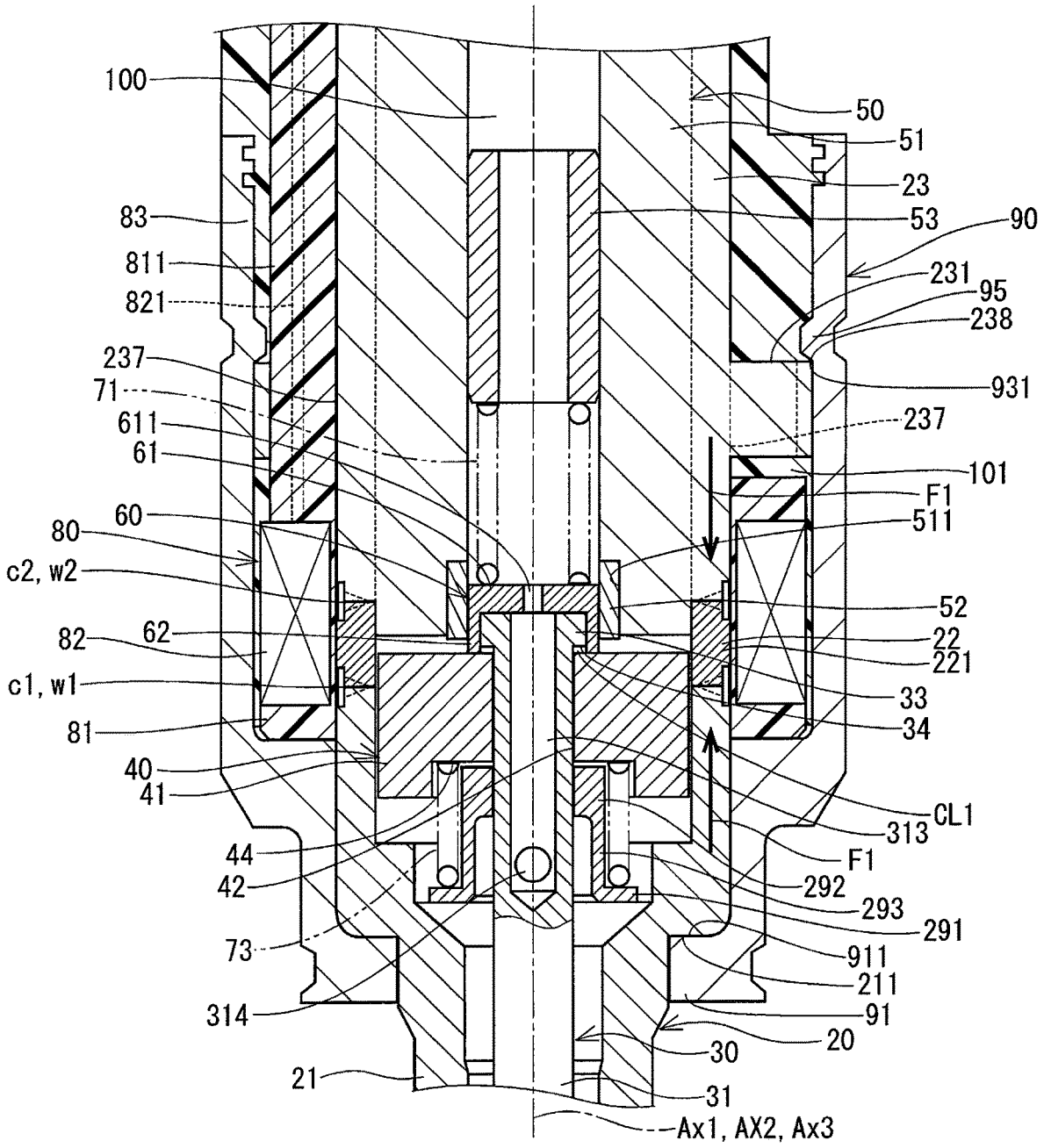
FIG. 9 is a sectional view illustrating a yoke of a fuel injection device of a sixth embodiment of the disclosure and the vicinity of the yoke.

FIG. 9 illustrates part of a fuel injection device of a sixth embodiment of the present disclosure. The sixth embodiment is different from the fifth embodiment specifically in a configuration of the yoke 90.

In the sixth embodiment, the yoke 90, having a cylindrical shape, has an upper-yoke crimp part 95 that annually protrudes to a radially inner side from the inner wall in the middle of the yoke in the axial direction. The upper-yoke stopping surface 931 opposed to the third-cylinder-part stopping surface 238 is provided in the surface of the upper-yoke crimp part 95 on the side closer to the valve seat 14.

The yoke 90 is crimped onto the third-cylinder-part protrusion 231 at the upper-yoke crimp part 95 such that the lower-yoke stopping surface 911 abuts on the first-cylinder-part stopping surface 211, and the upper-yoke stopping surface 931 abuts on the third-cylinder-part stopping surface 238. At this time, the axial force F1 along the axis Ax1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23.

The lower-yoke stopping surface 911 of the yoke 90 is stopped by the first-cylinder-part stopping surface 211 and thus limited in movement relative to the housing 20 to the side opposite to the valve seat 14. The upper-yoke stopping surface 931 of the yoke 90 is stopped by the third-cylinder-part stopping surface 238 and thus limited in movement relative to the housing 20 toward the valve seat 14.

A method of manufacturing the fuel injection device of the sixth embodiment is now described.

As described below, the method of manufacturing the fuel injection device of the sixth embodiment is different in the yoke assembling step from that of the fifth embodiment.

(Yoke Assembling Step)

The lower-yoke stopping surface 911 is allowed to abut on the first-cylinder-part stopping surface 211, and, for example, a tool is pressed from the radially outer side of the yoke 90 to form the upper-yoke crimp part 95 so that the upper-yoke stopping surface 931 abuts on the third-cylinder-part stopping surface 238, and thus the yoke 90 is crimped onto the third-cylinder-part protrusion 231 such that the axial force F1 having a predetermined magnitude is generated in the first and third cylinder parts 21 and 23 in the direction in which the first and third cylinder parts 21 and 23 approach each other.

As described above, in the sixth embodiment, the first cylinder part 21 has the first-cylinder-part stopping surface 211. The third cylinder part 23 has the third-cylinder-part stopping surface 238. The yoke 90 has the lower-yoke stopping surface 911 that is stopped by the first-cylinder-part stopping surface 211 and thus limited in movement relative to the housing 20 to the side opposite to the valve seat 14, and has the upper-yoke stopping surface 931 that is stopped by the third-cylinder-part stopping surface 238 and thus limited in movement relative to the housing 20 toward the valve seat 14. The yoke 90 is crimped onto the third-cylinder-part protrusion 231 and thus assembled in the housing 20. Hence, the yoke 90 can be assembled in the housing 20 relatively easily.

Seventh Embodiment

Figure 10:
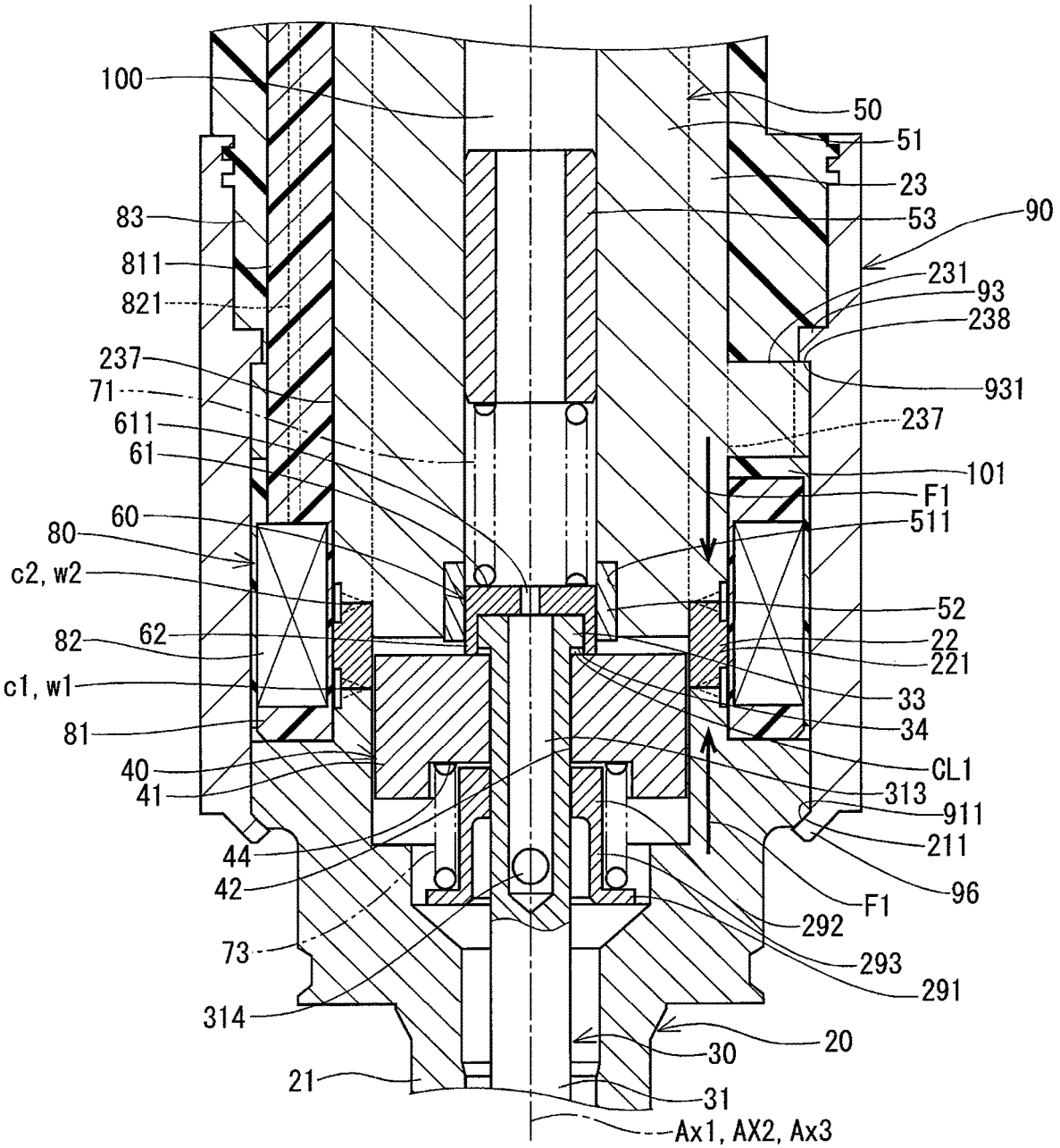
FIG. 10 is a sectional view illustrating a yoke of a fuel injection device of a seventh embodiment of the disclosure and the vicinity of the yoke.

FIG. 10 illustrates part of a fuel injection device of a seventh embodiment of the present disclosure. The seventh embodiment is different from the fifth embodiment specifically in a configuration of the yoke 90.

In the seventh embodiment, the first cylinder part 21 has the first-cylinder-part stopping surface 211. The yoke 90, having a cylindrical shape, has a lower-yoke crimp part 96 that annually protrudes to the radially inner side from the end portion of the yoke on the side closer to the valve seat 14. The lower-yoke stopping surface 911 opposed to the first-cylinder-part stopping surface 211 of the first cylinder part 21 is provided in the surface of the lower-yoke crimp part 96 on the side opposite to the valve seat 14.

The yoke 90 is crimped onto the first cylinder part 21 at the lower-yoke crimp part 96 such that the upper-yoke stopping surface 931 abuts on the third-cylinder-part stopping surface 238, and the lower-yoke stopping surface 911 abuts on the first-cylinder-part stopping surface 211. At this time, the axial force F1 along the axis Ax1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23.

The lower-yoke stopping surface 911 of the yoke 90 is stopped by the first-cylinder-part stopping surface 211 and thus limited in movement relative to the housing 20 to the side opposite to the valve seat 14. The upper-yoke stopping surface 931 of the yoke 90 is stopped by the third-cylinder-part stopping surface 238 and thus limited in movement relative to the housing 20 toward the valve seat 14.

A method of manufacturing the fuel injection device of the seventh embodiment is now described.

As described below, the method of manufacturing the fuel injection device of the seventh embodiment is different in the yoke assembling step from that of the fifth embodiment.

(Yoke Assembling Step)

The upper-yoke stopping surface 931 is allowed to abut on the third-cylinder-part stopping surface 238, and, for example, a tool is pressed from the radially outer side of the end portion of the yoke 90 on the side closer to the valve seat 14 to form the lower-yoke crimp part 96 so that the lower-yoke stopping surface 911 abuts on the first-cylinder-part stopping surface 211, and thus the yoke 90 is crimped onto the first cylinder part 21 such that the axial force F1 having a predetermined magnitude is generated in the first and third cylinder parts 21 and 23 in the direction in which the first and third cylinder parts 21 and 23 approach each other.

As described above, in the seventh embodiment, the first cylinder part 21 has the first-cylinder-part stopping surface 211. The third cylinder part 23 has the third-cylinder-part stopping surface 238. The yoke 90 has the lower-yoke stopping surface 911 that is stopped by the first-cylinder-part stopping surface 211 and thus limited in movement relative to the housing 20 to the side opposite to the valve seat 14, and the upper-yoke stopping surface 931 that is stopped by the third-cylinder-part stopping surface 238 and thus limited in movement relative to the housing 20 toward the valve seat 14. The yoke 90 is crimped onto the first cylinder part 21 and thus assembled in the housing 20. Hence, the yoke 90 can be assembled in the housing 20 relatively easily.

Eighth Embodiment

Figure 11:
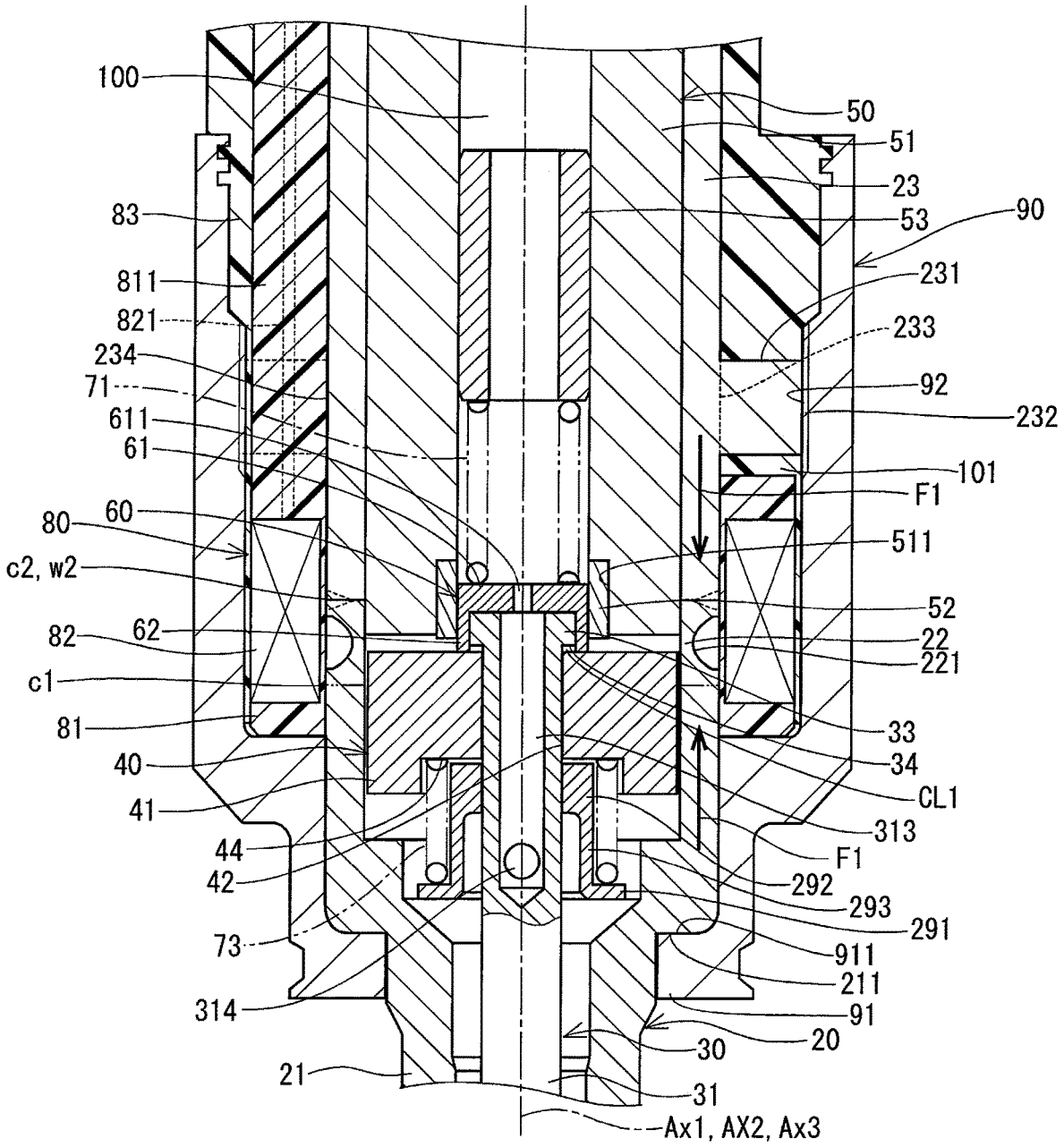
FIG. 11 is a sectional view illustrating a yoke of a fuel injection device of an eighth embodiment of the disclosure and the vicinity of the yoke.

FIG. 11 illustrates part of a fuel injection device of an eighth embodiment of the present disclosure. The eighth embodiment is different from the first embodiment specifically in configurations of the first, second, and third cylinder parts 21, 22, and 23 and the yoke 90.

In the eighth embodiment, the first and second cylinder parts 21 and 22 are integrally made of a magnetic material such as ferritic stainless steel, for example. That is, the first and second cylinder parts 21 and 22 are integrally made of the same material. The second cylinder part 22 has the magnetic throttle part 221 in a part of the second cylinder part 22 in the axial direction. The magnetic throttle part 221 has a smaller thickness than the remaining portion in the axial direction of the second cylinder part 22. The end portion of the second cylinder part 22 on the side closer to the third cylinder part 23 is welded to the third cylinder part 23. The third cylinder part 23 and the stationary core body 51 of the stationary core 50 are separately formed by different components from each other. The stationary core body 51 is provided inside the third cylinder part 23 by press fitting, for example. The third-cylinder-part screw part 232 is formed over the entire axial area of the third-cylinder-part protrusion 231. The upper-yoke screw part 92 that can be screwed with the third-cylinder-part screw part 232 is provided on the inner wall in the middle of the yoke 90 in the axial direction.

A method of manufacturing the fuel injection device of the eighth embodiment is now described.

As described below, the method of manufacturing the fuel injection device of the eighth embodiment is different in the housing welding step from that of the first embodiment. The method of manufacturing the fuel injection device of the eighth embodiment includes a stationary core press-fitting step, but does not include the yoke welding step described in the first embodiment.

(Stationary Core Press-Fitting Step)

The stationary core body 51 is press-fitted into the third cylinder part 23.

(Housing Welding Step)

While the needle 30, the movable core 40, and the like are accommodated within the housing 20, the second cylinder part 22 is welded to the third cylinder part 23.

(Coil Assembling Step)

The coil 80 is assembled onto the outer side of the housing 20 such that the bobbin extension 811 is located in the groove 234.

(Yoke Assembling Step)

The lower-yoke stopping surface 911 is allowed to abut on the first-cylinder-part stopping surface 211, and the upper-yoke screw part 92 is screwed with the third-cylinder-part screw part 232, and thus the yoke 90 is assembled in the housing 20 such that the axial force F1 having a predetermined magnitude is generated in the first and third cylinder parts 21 and 23 in the direction in which the first and third cylinder parts 21 and 23 approach each other.

As described above, the second cylinder part 22 is integrally formed with the first cylinder part 21. It is therefore possible to reduce the number of components and the number of assembling. In the eighth embodiment, the yoke 90 is also provided such that the axial force F1 is generated in the first and third cylinder parts 21 and 23 in the direction in which the first and third cylinder parts 21 and 23 approach each other. Hence, a contractile force in the axis Ax1 direction acts on the second cylinder part 22 forming the magnetic throttle part 221 from the first and third cylinder parts 21 and 23. As a result, even if the fuel pressure in the fuel passage 100 increases, it is possible to suppress "a force by which the components separate from each other in the axis Ax1 direction", which acts on the connection c2 between the second and third cylinder parts 22 and 23 or on the magnetic throttle part 221. It is therefore possible to suppress stress concentration on the connection c2 between the second and third cylinder parts 22 and 23 or on the magnetic throttle part 221, and suppress break caused by the stress concentration. Consequently, in the eighth embodiment, high-pressure fuel can be injected while fuel leakage is suppressed as in the first embodiment.

OTHER EMBODIMENTS

In the exemplary case of the eighth embodiment, the second cylinder part 22 is integrally formed with the first cylinder part 21. On the other hand, in another embodiment of the present disclosure, the second cylinder part 22 may be formed integrally with the third cylinder part 23 as long as it forms the magnetic throttle part 221 by thickness reduction, for example. The second cylinder part 22 may be formed integrally with each of the first and third cylinder parts 21 and 23.

In the exemplary case of the fifth embodiment, the first yoke screw part 903 is formed on the inner wall of the first yoke 901, and the second yoke screw part 904 is formed on the outer wall of the second yoke 902. On the other hand, in another possible embodiment of the present disclosure, the first yoke screw part 903 is formed on the outer wall of the first yoke 901, and the second yoke screw part 904 is formed on the inner wall of the second yoke 902.

In another embodiment of the present disclosure, the housing 20 may be made of a metal other than stainless steel, such as iron and aluminum, for example.

In the exemplary case of each of the above-described embodiments, the nozzle 10 is formed separately from the first cylinder part 21. On the other hand, in another embodiment of the present disclosure, the nozzle 10 may be formed integrally with the first cylinder part 21.

In another embodiment of the present disclosure, the gap formation component 60 may not be provided. In such a case, no axial gap is formed between the abutment surface 34 of the rib 33 and the movable core 40 in the valve opening state. In another embodiment of the present disclosure, the movable core 40 may be formed integrally with the needle 30. In another embodiment of the present disclosure, at least one of the spring seat part 291, the fixing part 292, the cylinder part 293, and the spring 73 may not be provided.

In the exemplary case of each of the above-described embodiments, the screw coupling component 26 is screwed with the cylindrical component 25 configuring the fuel inlet together with the inlet part 24. On the other hand, in another embodiment of the present disclosure, the screw coupling component 26 may be screwed with the fuel pipe 6 such that the cylindrical component 25 is coupled to the fuel pipe 6 in a closely contact manner.

In another embodiment of the present disclosure, the cylindrical component 25 and the screw coupling component 26 may not be provided.

In another embodiment of the present disclosure, the fuel injection device may be attached to the engine 2 so as to be pressed against the stepped surface and the like of the attachment hole 5 with a predetermined force by a distributing pipe of a fuel rail, for example.

In another embodiment of the present disclosure, the above-described embodiments can be appropriately combined as long as a structurally obstructive factor does not exist.

The present disclosure can be applied not only to the direct-injection gasoline engine, but also to a port injection gasoline engine or a diesel engine.

As described above, the present disclosure should not be limited to the above-described embodiments, and can be carried out in various modes without departing from the gist of the disclosure.

The invention claimed is:

1. A fuel injection device, comprising:

a nozzle including an injection hole that injects fuel, and a valve seat annually formed around the injection hole;

a housing including a first cylinder part having a first end connected to the nozzle, a second cylinder part having a first end connected to a second end of the first cylinder part and forming a magnetic throttle part in at least a part of the second cylinder part in an axis direction, a third cylinder part having one end connected to a second end of the second cylinder part, and a fuel passage formed inside the first cylinder part, the second cylinder part, and the third cylinder part so as to communicate with the injection hole and guide the fuel to the injection hole;

a needle that includes a rod-like needle body and a seal part formed annually at one end of the needle body so as to be able to abut on the valve seat, and opens or closes the injection hole as the seal part separates from or abuts on the valve seat;

a movable core provided so as to be able to reciprocate together with the needle within the housing;

a stationary core provided on a side opposite to the valve seat with respect to the movable core inside the second cylinder part and the third cylinder part;

a valve-seat-side biasing component capable of biasing the needle and the movable core toward the valve seat;

a cylindrical yoke having a first end side connected to the first cylinder part and a second end side connected to the third cylinder part, and provided on a radially outer side of the housing such that an axial force is generated in the first cylinder part and the third cylinder part in a direction in which the first cylinder part and the third cylinder part approach each other; and a contractile force in the axial direction acts on the second cylinder part from the first cylinder part and the third cylinder part; and a coil that is provided between the housing and the yoke, and is energized to be able to form a magnetic circuit through the first cylinder part, the movable core, the stationary core, the third cylinder part, and the yoke, and thus able to attract the movable core toward the stationary core and move the needle to the side opposite to the valve seat, wherein the first cylinder part has a first-cylinder-part stopping surface, the third cylinder part has a third-cylinder-part stopping surface, and the yoke has a lower-yoke stopping surface that is stopped by the first-cylinder-part stopping surface and thus limited in movement relative to the housing to a side opposite to the valve seat, and an upper-yoke stopping surface that is stopped by the third-cylinder-part stopping surface and thus limited in movement relative to the housing toward the valve seat.

2. The fuel injection device according to claim 1, wherein the yoke includes a first yoke having the lower-yoke stopping surface, and the second yoke having the upper-yoke stopping surface, the first yoke has a first yoke screw part on one of an inner wall and an outer wall of the first yoke, and the second yoke has a second yoke screw part screwed with the first yoke screw part on one of an outer wall and an inner wall of the second yoke.

3. The fuel injection device according to claim 1, wherein the second cylinder part is formed integrally with at least one of the first cylinder part and the third cylinder part.

4. The fuel injection device according to claim 1, wherein the third cylinder part is formed integrally with the stationary core.

5. The fuel injection device according to claim 1, wherein the needle has an abutment surface capable of abutting on a surface of the movable core on a side closer to the stationary core, the movable core is provided movably relative to the needle so as to be able to abut on or separate from the abutment surface, and the fuel injection device further comprises a gap formation component capable of forming an axial gap between the abutment surface and the movable core.

6. The fuel injection device according to claim 1, the fuel injection device receiving fuel from an outside through a fuel pipe, further comprising:

a cylindrical fuel inlet having a first end connected to the second end of the third cylinder part and a second end connected to the fuel pipe, and guiding the fuel from the outside to the fuel passage, and a screw coupling component screwed with one of the fuel inlet and the fuel pipe such that the fuel inlet is coupled to the fuel pipe in a closely contact manner.

* * * * *